United States Patent [19]

Ringgenberg et al.

[11] Patent Number: 4,848,463

[45] Date of Patent: Jul. 18, 1989

[54] SURFACE READ-OUT TESTER VALVE AND PROBE

[75] Inventors: Paul D. Ringgenberg; Burchus O. Barrington, both of Duncan, Okla.

[73] Assignee: Halliburton Company, Duncan, Okla.

[21] Appl. No.: 269,387

[22] Filed: Nov. 9, 1988

[51] Int. Cl.[4] ..... E21B 23/00; E21B 34/10; E21B 43/12; E21B 49/08

[52] U.S. Cl. ..... 166/250; 166/237; 166/264; 166/319; 166/332; 166/374; 166/386

[58] Field of Search ..... 166/250, 264, 237, 238, 166/239, 240, 319, 332, 374, 386

[56] References Cited

U.S. PATENT DOCUMENTS

| | | | |
|---|---|---|---|
| Re. 31,313 | 7/1983 | Fredd et al. | 166/250 |
| 3,434,535 | 3/1969 | Page | 166/72 |
| 4,050,512 | 9/1977 | Griebeler | 166/240 X |
| 4,274,286 | 6/1981 | Fredd | 166/250 |
| 4,355,685 | 10/1982 | Beck | 166/240 |
| 4,453,599 | 6/1984 | Fredd | 166/374 |
| 4,487,261 | 12/1984 | Gazda | 166/264 |
| 4,650,001 | 3/1987 | Ringgenberg | 166/240 X |
| 4,667,743 | 5/1987 | Ringgenberg et al. | 166/321 |
| 4,678,035 | 7/1987 | Goldschild | 166/250 |
| 4,750,560 | 6/1988 | Gazda | 166/240 |

OTHER PUBLICATIONS

Brochure entitled "Otis Downhole Shut-In Tool" published by Otis Engineering Corporation of Dallas, Texas, 1982.

*Primary Examiner*—Stephen J. Novosad

*Attorney, Agent, or Firm*—James R. Duzan; Lucian W. Beavers

[57] ABSTRACT

A well testing apparatus includes a housing having a formation fluid flow passage. A sliding sleeve tester valve is reciprocably disposed in the housing. A probe separable from the housing and constructed to be received coaxially within the sliding sleeve tester valve has a probe passage defined therethrough for communicating the formation fluid flow passage with a measuring device carried on the probe. A probe valve is also disposed in the housing and is constructed to receive a lower end of the probe. A releasable connector operably connects the probe and the sliding sleeve tester valve so that the sliding sleeve tester valve is moved between its open and closed positions in response to reciprocal movement of the probe relative to the housing. The tester valve can be operated an indefinite number of times, and whenever desired the probe can be disconnected from the tester valve in response to an appropriately timed reciprocable motion of the probe.

20 Claims, 17 Drawing Sheets

SURFACE READ-OUT TESTER VALVE AND PROBE

BACKGROUND OF THE INVENTION

1. Field Of The Invention

The present invention relates to apparatus for measuring properties of well fluids produced from an oil or gas well at a downhole location.

2. Description Of The Prior Art

A tester valve is a valve placed downhole in a testing string of a well for selectively opening and closing the testing string to allow formation fluids to flow upward through the well. The prior art includes a number of different forms of apparatus which provide a probe which is lowered on an electric wireline into engagement with such a tester valve for operating the tester valve and for measuring properties such as pressure and temperature of the produced fluids both while the fluids are flowing and while the well is shut in. Signals from a measuring apparatus contained in the probe are transmitted up the wireline. Tester valves designed for such use are often referred to as surface read-out tester valves.

One such apparatus is disclosed in U.S. Pat. No. 4,678,035 to Goldschild which is assigned to Schlumberger Technology Corporation of Houston, Tex. The Goldschild device provides a probe suspended on a wireline, which is lowered into engagement with a tester valve for manipulating the tester valve and for measuring properties of the produced fluid. The probe of the Goldschild device latches into place within the tester valve with a pair of spring-biased latches, which are subsequently released by a cam mechanism after a predetermined number of reciprocations of the Goldschild probe relative to the tester valve.

Another such device is shown in U.S. Pat. No. 4,487,261 to Gazda which is assigned to Otis Engineering Corporation of Dallas, Tex. The Gazda probe also latches into its tester valve with a spring-loaded latch. The Gazda device, however, can be reciprocated an indeterminate number of times to open and close a tester valve which is actually contained in the probe. When it is desired to retrieve the probe and its integral tester valve, an upward pull is applied to the wireline in order to disengage the probe. The upward pull required to disengage the probe is greater than the upward pull required to move the probe between the open and closed positions of the tester valve.

SUMMARY OF THE PRESENT INVENTION

The present invention provides an improved surface readout tester valve and probe assembly which incorporates many improvements as compared to the prior art devices. The apparatus of the present invention provides a positive mechanical interlock between the probe and tester valve. The probe can be reciprocated an infinite number of times to open and close the tester valve and provide the desired test data. At any time, by appropriate reciprocation of the probe, the probe can be disengaged from the tester valve.

The well testing apparatus of the present invention includes a housing having a formation fluid flow passage defined therethrough. A sliding sleeve tester valve is reciprocably disposed in the housing and movable between an open position wherein the flow passage is open and a closed position wherein the flow passage is closed. A probe, separable from the housing and constructed to be coaxially received within the sliding sleeve tester valve, includes a probe passage defined therein for communicating the formation fluid flow passage with a measuring means carried on the probe. A probe valve is disposed in the housing, and the probe valve is constructed to receive a lower end of the probe. The probe valve is movable between an open position wherein the flow passage of the housing is communicated with the probe passage of the probe, and a closed position wherein the flow passage of the housing is isolated from the probe passage of the probe.

A releasable connecting means is provided for operably connecting the probe and the tester valve so that the tester valve is moved between its open and closed positions in response to a reciprocal movement of the probe relative to the housing.

When the probe is connected to the tester valve by the releasable connecting means, and the tester valve is in either of its open and closed positions, the probe valve remains in its open position.

The releasable connecting means includes a slot carried by the probe which defines a first and second path. A lug is carried by the tester valve and is received in the slot for selective movement along either of the first and second paths.

The probe includes a hydraulic time delay means for retarding relative reciprocal motion between the probe and the tester valve, and for thereby causing the lug to selectively move into a preferred one of the first and second paths of the slot in response to an appropriate timing of said relative reciprocal motion.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIGS. 6A–6J comprise an elevation cross-sectional view similar to FIGS. 5A–5J, wherein the probe has been reciprocated upward to move the tester valve apparatus to an open position. The probe valve is in an open position communicating the flow passage of the housing with the probe passage of the probe.

DETAILED DESCRIPTION OF THE PREFERRED EMBODIMENTS

Figure 1:
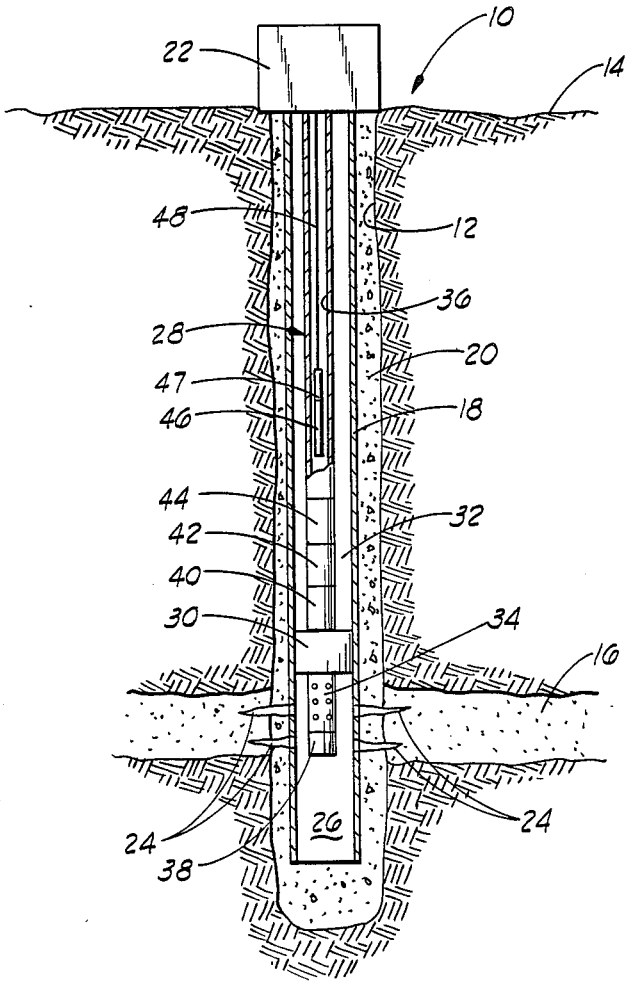
FIG. 1 is a schematic elevation sectioned view of the apparatus of the present invention in place in a well.

In FIG. 1 a schematic elevation sectioned view is shown of an oil or gas well 10 having the apparatus of the present invention installed therein.

The well 10 is constructed by drilling a borehole 12 down from the earth's surface 14 to a depth intersecting a subsurface formation 16.

A well casing 18 is cemented within the borehole 12 by cement 20. the upper end of the well 10 is closed by a conventional wellhead assembly schematically illustrated as 22.

The casing 18 and cement 20 have been perforated by perforations 24 so as to provide fluid communication between the subsurface formation 16 and an interior 26 of the casing 18.

A pipe string or testing string 28 has been lowered into the well 10. The testing string includes an expandable packer 30 which has been set within the casing 18 at an elevation slightly above the subsurface formation 16, so as to isolate a tubing-casing annulus 32 from the subsurface formation 16.

The testing string includes a perforated anchor pipe 34 extending below packer 30 which communicates the interior 26 of casing 18 with an inner bore 36 of testing string 28. A self-contained pressure gauge 38 may be located below perforated anchor pipe 34.

Located above the packer 30 is a safety joint 40, a jar apparatus 42 and the tester valve apparatus 44 of the present invention.

A probe 46 of the present invention is shown as it is being lowered down through the interior 36 of testing string 28 on a wireline 48. A measuring means 47 is carried by probe 46 for measuring fluid properties such as pressure or temperature. Probe 46 also carries sufficient weight to provide the necessary downward force to operate tester valve apparatus 44 when tension is slacked off on wireline 48.

The tester valve apparatus 44 and probe 46 may be collectively referred to as a well testing apparatus 50.

In FIGS. 2A–2F, an elevation sectioned view is shown of the tester valve apparatus 44 of well testing apparatus 50.

Tester valve apparatus 44 includes a housing generally designated by the numeral 52, which has a formation fluid flow passage 54 defined therethrough.

The housing 52 is comprised of a top adapter 56, a spring case 58, a main case 60, a stationary flow mandrel 62, a stationary pressure mandrel 64, a reversing nipple 66, a bar catching mandrel 68, and a bottom adapter 70.

Top adapter 56 and spring case 58 are threadedly connected at 72 with an O-ring seal means 74 being provided therebetween.

Spring case 58 and main case 60 are threadedly connected at 76 with an O-ring seal 78 being provided therebetween.

Stationary flow mandrel 62 has an upper end 80 which is closely received within a lower counterbore 82 of spring case 58.

Stationary flow mandrel 62 and stationary pressure mandrel 64 are threadedly connected at 84 with an O-ring seal 86 being provided therebetween.

Reversing nipple 66 includes a reduced diameter upper extension 88 which is integral therewith. Stationary pressure mandrel 64 is threadedly connected to reduced diameter extension 88 at 90 with an O-ring seal 92 being provided therebetween.

Main case 60 is also threadedly connected to reversing nipple 66 at 94 with an O-ring seal 96 being provided therebetween.

Reversing nipple 66 is threadedly connected to bottom adapter 70 at 98 with an O-ring seal 100 being provided therebetween.

Bar catching mandrel 68 has an upper inner cylindrical counterbore 102 within which a reduced diameter lower end 104 of reversing nipple 66 is closely received with an O-ring seal 106 being provided therebetween.

A lower end 108 of bar catching mandrel 68 rests upon an upward facing annular shoulder 110 of bottom adapter 70.

Figure 2A:
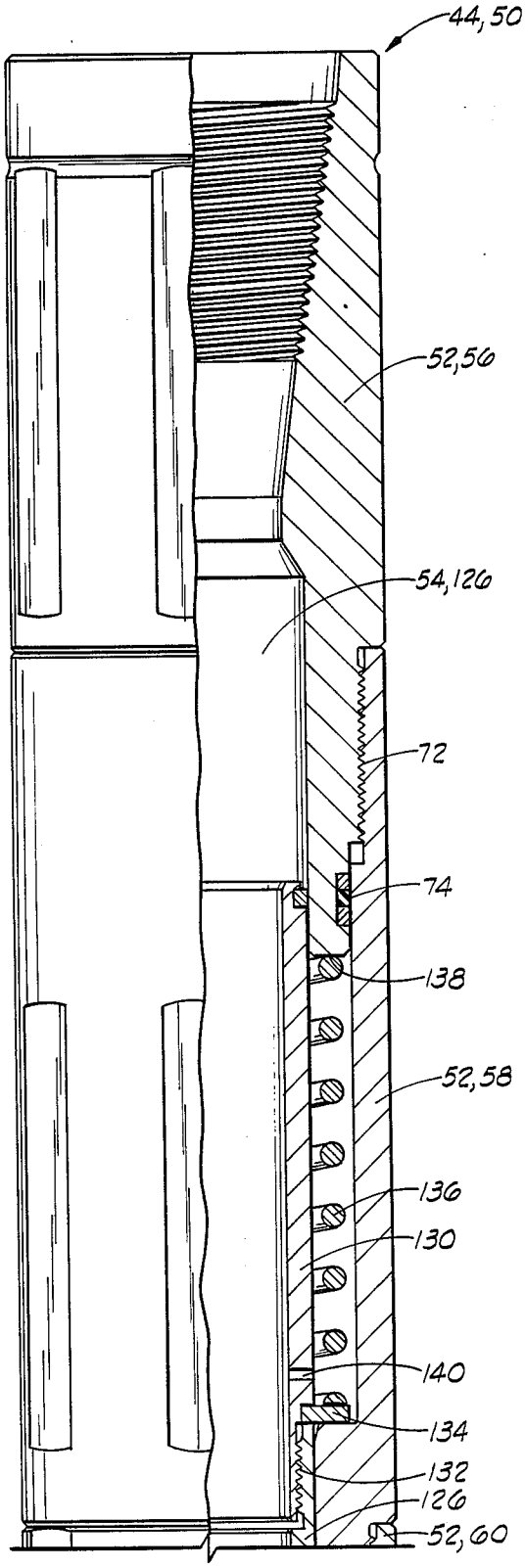
FIGS. 2A–2F comprise an elevation sectioned view of the tester valve apparatus of the present invention.
Figure 2B:
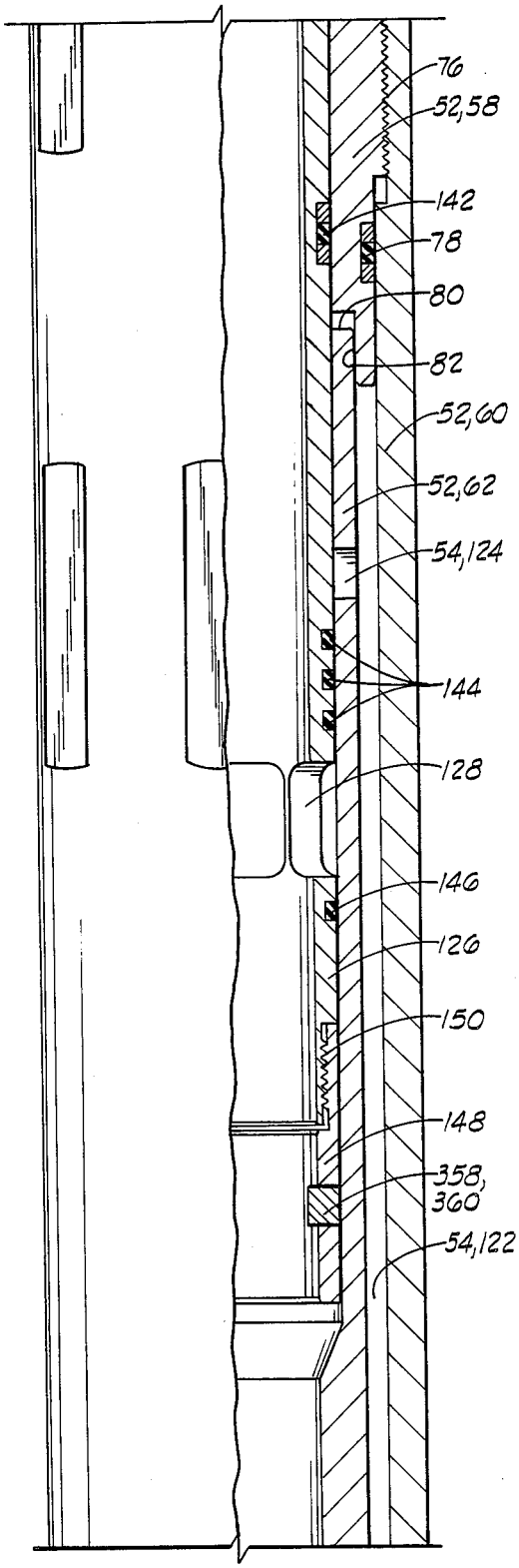
Figure 2C:
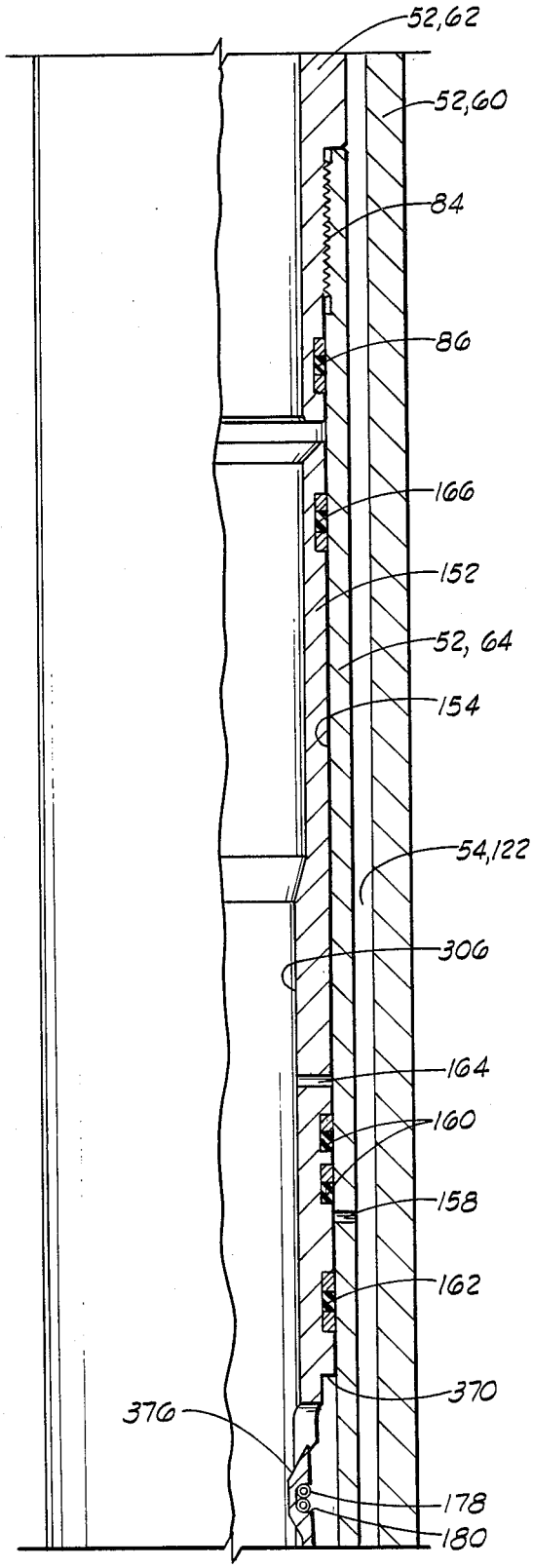
Figure 2D:
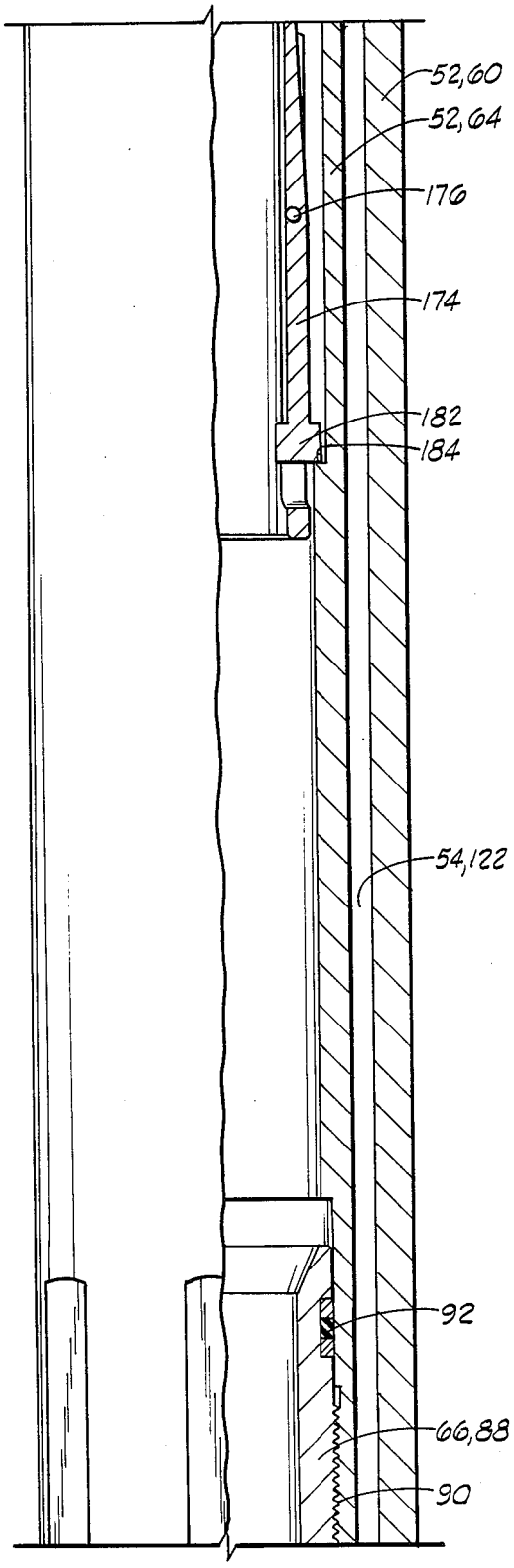
Figure 2E:
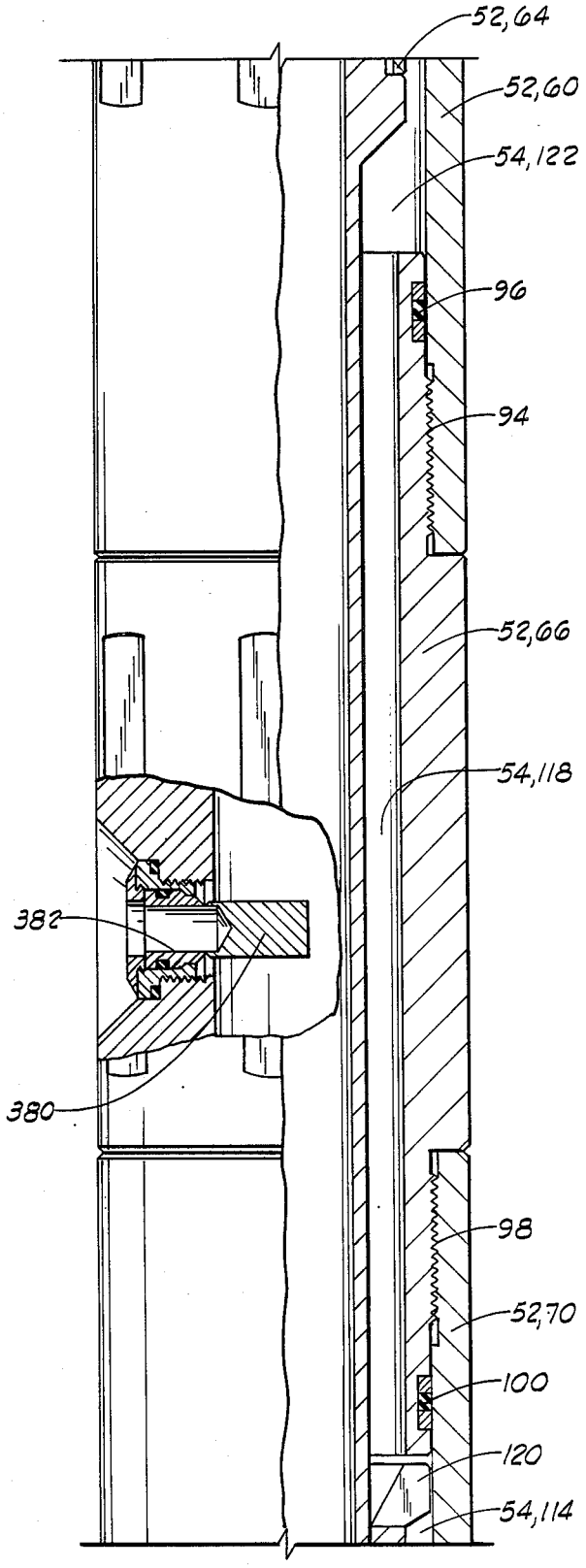
Figure 2F:
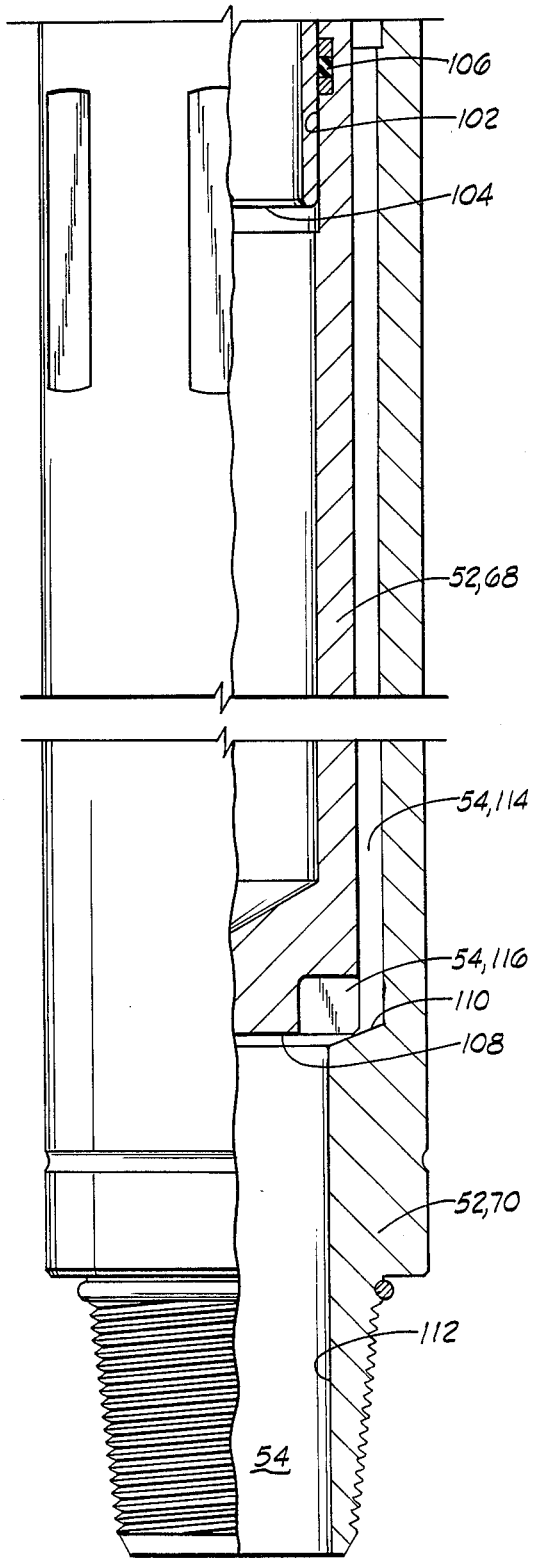

The formation fluid flow passage 54 which is defined within housing 52 will now be traced beginning at the lower end of housing 52 in FIG. 2F.

The flow passage 54 begins with an inner bore 112 in the lower portion of bottom adapter 70.

Flow passage 54 continues as an annular space 114 defined between an upper portion of bottom adapter 70 and the outer surface of bar catching mandrel 68.

Annular space 114 communicates with bore 112 through a plurality of slots 116 cut around the lower periphery of bar catching mandrel 68.

Flow passage 54 continues upward as a plurality of longitudinal offset bores such as 118 defined through reversing nipple 66. The lower end of bores 118 communicate with annular space 114 through a plurality of slots 120 cut in the upper periphery of bar catching mandrel 68.

Flow passage 54 then continues upward as another annular space 122 defined on the outside by main case 60, and on the inside by portions of reversing nipple 66, stationary pressure mandrel 64, and stationary flow mandrel 62.

Flow passage 54 includes a plurality of valve ports 124 disposed radially through stationary flow mandrel 62 as seen in FIG. 2B.

In a manner further described below, the valve ports 124 are selectively communicated with a bore 126 of top adapter 56 which defines the upper extremity of the flow passage 54 through housing 52.

As best seen in FIGS. 2A–2B, the tester valve apparatus 44 includes a sliding sleeve tester valve 126 which may also be referred to as a sliding valve mandrel 126 which is reciprocably dispsed within the housing 52 and is movable between an open position as is best seen in FIGS. 6A–6J and a closed position as illustrated in FIGS. 2A–2F and 5A–5J.

In the closed position of sliding sleeve tester valve 126 as seen in FIGS. 2A–2F, the sliding sleeve tester valve 126 isolates valve ports 124 of stationary flow mandrel 62 from the upper bore 126 thus closing the flow passage 54. In the open position of FIGS. 6A–6J, a plurality of windows 128 in sliding sleeve tester valve 126 are aligned with valve ports 124 in statonary flow mandrel 62 to communicate valve ports 124 with the bore 126 of top adapter 56.

A spring mandrel 130 is threadedly connected to an upper end of sliding sleeve tester valve 126 at 132. An annular spring washer 134 is sandwiched between the upper end of sliding sleeve tester valve 126 and a downward facing shoulder of spring mandrel 130 and held tightly therebetween.

An annular resilient coil spring 136 is concentrically disposed about spring mandrel 130. The upper end of spring 136 engages a lower end 138 of top adapter 56. A lower end of spring 136 engages spring washer 134.

The spring 136 biases the sliding sleeve tester valve 126 downward relative to housing 52 toward the closed position of sliding sleeve tester valve 126.

A pressure relief port 140 is disposed through spring mandrel 130.

Sliding sleeve tester valve 126 carries three sets of O-rings seals on its outer surface, including an upper valve seal 142, three intermediate valve seals 144, and a lower valve seal 146.

When the sliding sleeve tester valve 126 is in its closed position as shown in FIGS. 2A–2B, the valve port 124 of stationary flow mandrel 62 is located between upper valve seal 142 and intermediate valve seals 144.

A lug ring 138 is threadedly connected to a lower end of sliding sleeve tester valve 126 at 150.

Referring now to FIGS. 2C–2D, a probe valve 152, which can also be generally referred to as an inner sliding pressure mandrel 152, is slidably disposed within an inner bore 154 of stationary pressure mandrel 64. The probe valve 152 is constructed to receive a lower end of the probe 46 as is further described below and is illustrated in FIGS. 5A–5J and 6A–6J.

The probe valve 152 is movable between an open position as seen in FIGS. 5F–5G and 6F–6G and a closed position as illustrated in FIGS. 2C–2D.

In the open position of the probe valve 152, the flow passage 54 of housing 52 is communicated with a probe passage means 156 defined in the probe 46. When the probe valve 152 is in its closed position, the flow passage 54 is isolated from the probe passage means 156.

As is apparent in FIGS. 1 and 3A–3F, the probe 46 is separable from the housing 52 of tester valve apparatus 44, and is constructed to be received coaxially within the sliding sleeve tester valve 126. The probe passage means 156 of probe 46 is defined in the probe 46 for communicating the formation fluid flow passage 54 with the measuring means 47 carried on the probe 46.

Stationary pressure mandrel 64 has a port 158 disposed therethrough as seen in FIG. 2C. When the probe valve 152 is in its closed position port 158 is located between a pair of intermediate probe seals 160 and a lower probe seal 162. Probe valve 152 has a probe valve port 164 disposed therethrough above the intermediate probe seals 160. When probe valve 152 moves downward relative to housing 52 to its open position, the probe valve port 164 is communicated with port 158.

Probe valve 152 has an upper probe valve seal 166. When the probe valve 152 is in its open position as seen in FIG. 6F, the upper probe valve seal 166 and intermediate probe valve seals 160 are located above and below the port 158 of stationary pressure mandrel 62. Port 158 communicates with probe valve port 164 through a small annular clearance 168 between an outer cylindrical surface 170 of probe valve 152 and an inner bore 172 of stationary pressure mandrel 64.

Probe valve 152 is initially releasably locked in its closed position by a plurality of pivotable latches 174 which pivot on pins 176. A resilient spring band 178 is received within outer notches 180 in the upper ends of latches 174 and biases the upper ends of latches 174 radially inward so that a lower latch lug 182 engages an upward facing annular shoulder 184 of stationary pressure mandrel 64 to prevent downward movement of probe valve 152.

In a manner which is further described below, when the probe 46 is stabbed downward into the probe valve 152, it releases the latches 174 so the probe valve 152 can move downward to its open position.

Referring now to FIGS. 3A–3F, the probe 46 includes the differential case 186 threadedly connected to a sealing case 188 at threaded connection 190.

A jar mandrel 192 has an intermediate outer cylindrical surface 194 slidably received within a bore 196 of sealing case 188 with a pair of sliding O-ring seals 198 disposed in the outer surface 194. A relief port 200 is disposed through sealing case 188 above seals 198.

An upper reduced diameter outer surface 202 of jar mandrel 192 is closely received within a bore 204 of differential case 186. A plurality of O-ring seals 206 and a wiper ring 208 are disposed in bore 204 for sealing between bore 204 and outer surface 202.

A lower reduced diameter outer surface 210 of jar mandrel 192 is closely received within a lower inner bore 212 of sealing case 188, and a plurality of O-ring seals 214 and a wiper ring 216 are disposed therebetween.

An annular space 218 defined between jar mandrel 192 and sealing case 188 is communicated with an inner axial bore 220 of jar mandrel 192 by a jar mandrel equalizing port 222.

A lower end of jar mandrel 192 is threadedly connected to a J-slot adapter 224 at threaded connection 226, with an O-ring seal 228 being provided therebetween.

A J-slot collar 230 is freely, rotatably received about an outer cylindrical surface 232 of J-slot adapter 224.

A lower end of J-slot adapter 224 is threadedly connected to a J-slot retainer 234 at threaded connection 236.

A lower end of J-slot retainer 236 is threadedly connected to an oil chamber case 238 at threaded connection 240.

A lower end of oil chamber case 238 is threadedly connected to a metering case 242 at threaded connection 244 with an O-ring seal 246 being provided therebetween.

A sealing mandrel 248 has an enlarged diameter cylindrical outer surface 250 at its lower end which is closely and slidably received within a bore 252 of metering case 242 with a pair of O-ring seals 254 provided therebetween.

A similar diameter upper cylindrical outer surface 256 of sealing mandrel 248 is closely and slidably received within a bore 260 of J-slot adapter 224 with a pair of O-ring seals 262 being provided therebetween.

A metering spring 264 is received about a lower portion of sealing mandrel 248 and its lower end rests upon an upward facing annular shoulder 266 of sealing mandrel 248. An upper end of metering spring 264 abuts an annular slidable metering piston 268 which is slidably disposed in an annular space 270 defined between sealing mandrel 248 and metering case 242.

There is a relatively small annular clearance 272 defined between an inner bore 274 of metering piston 268 and an intermediate portion 276 of outer cylindrical surface 256 of sealing mandrel 248.

Another annular space 278 is defined between sealing mandrel 248 and oil chamber case 238. A floating piston 280 separates the annular space 278 into an upper portion 282 and a lower portion 284. Floating piston 280 carries inner and outer seals 286 and 288.

A relief port 290 is disposed through oil chamber case 238 adjacent the upper end of annular space 278.

Sealing mandrel 248 includes a lower reduced diameter portion 292 located below outer cylindrical surface 250. A lower end of sealing mandrel 248 is threadedly connected to a sealing coupling 294 at 296.

An outer cylindrical surface 298 of sealing coupling 294 is closely received within a lower inner bore 300 of metering case 242 with a pair of sliding O-ring seals 302 disposed therebetween.

Sealing coupling 294 includes an enlarged diameter cylindrical outer surface 304 which is constructed to be closely received within a bore 306 (see FIG. 2C) of probe valve 152. When the probe 46 is so received within probe valve 152, as seen in FIGS. 5F–5G, a pair of upper probe seals 308 and a pair of loawer probe seals 310 are located above and below, respectively, the probe valve port 164.

Sealing coupling 294 includes a plurality of radially offset longitudinal bypass passages 311 which permit fluid to flow upward therethrough as probe 46 is stabbed down into the tester valve apparatus 44 which of course will generally be filled with well fluids.

A lower latch 312 is threadedly connected to sealing coupling 294 at threaded connection 314 with a seal being provided therebetween by O-ring 316.

Lower latch 312 carries a plurality of centering springs 318. A lower end 320 of lower latch 312 has a conically tapered surface 322 for aid in stabbing the probe 46 into the tester valve apparatus 44.

Above the lower end 320 there is an annular groove 324 cut into lower latch 312 for receiving the latch lugs 182 of probe valvwe 152 in a manner further described below.

The details of construction of the probe passage means 156 defined through probe 46 will now be described.

Probe passage means 156 begins with an angled passage 326 communicating an annular groove 328 on the outer periphery of sealing coupling 298 with a longitudinal bore 330 disposed through sealing coupling 294.

Bore 330 is communicated with a bore 332 of sealing mandrel 248.

Figure 3A:
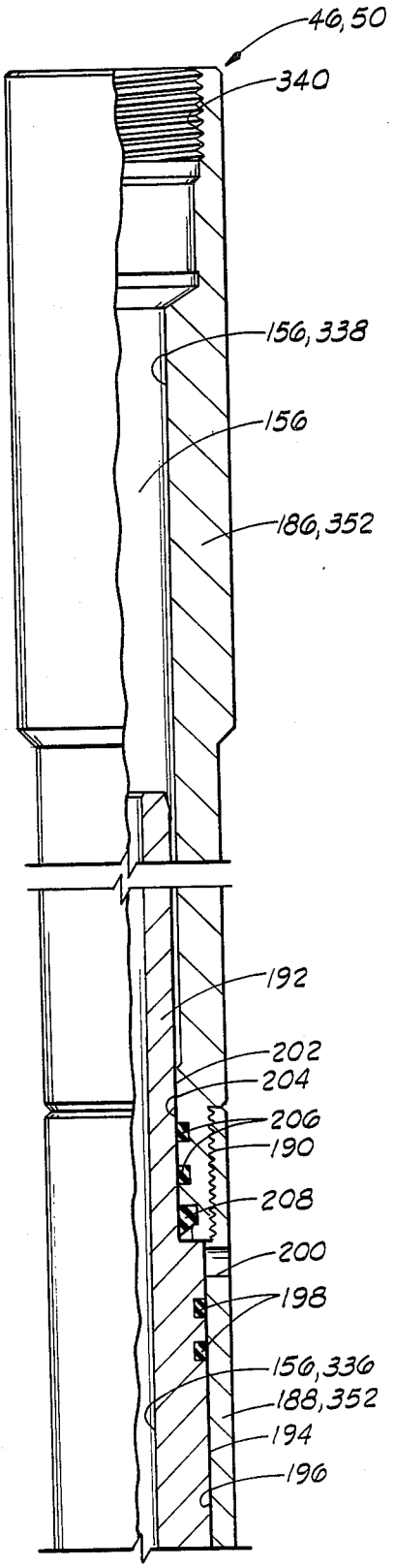
FIGS. 3A–3F comprise an elevation sectioned view of the probe of the present invention, which is to be received within the tester valve apparatus of FIG. 2.
Figure 3B:
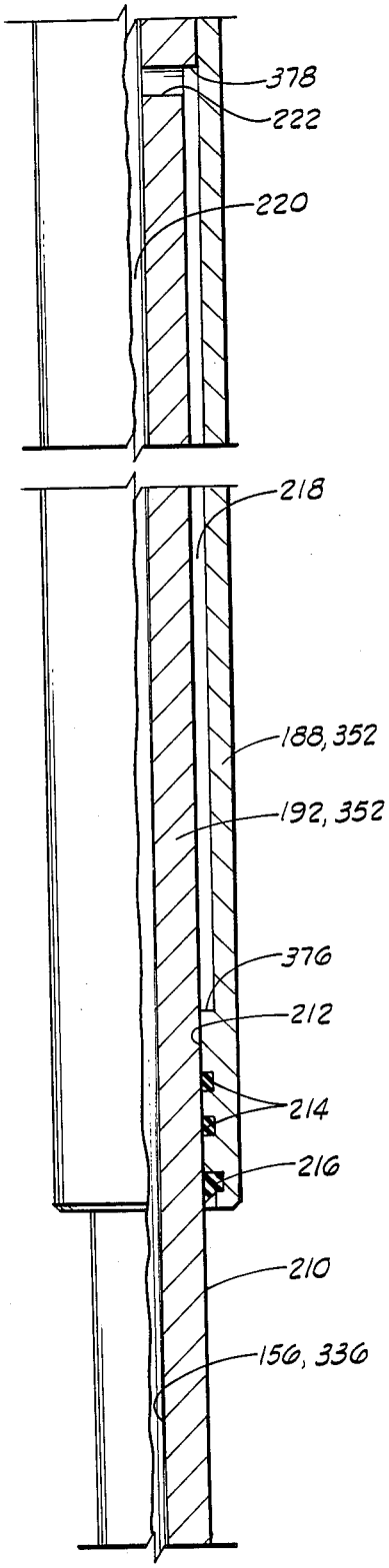
Figure 3C:
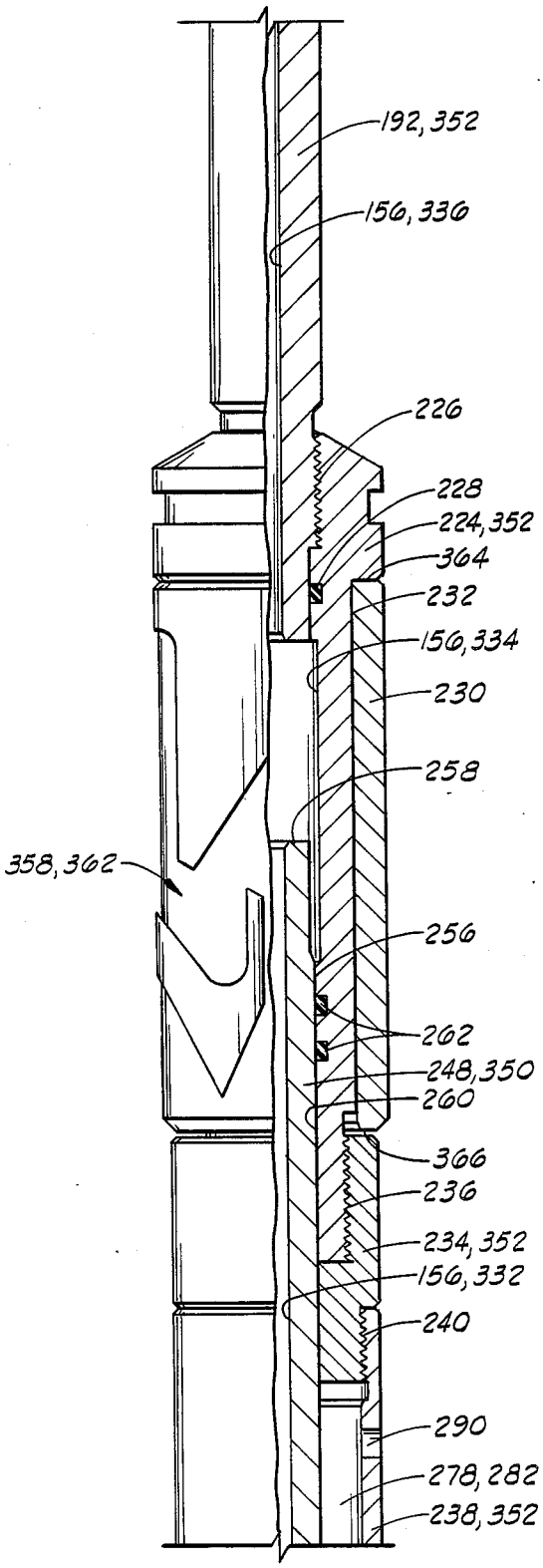

The upper end of bore 332 seen in FIG. 3C communicates with a bore 334 of J-slot adapter 224 and then with a bore 336 of jar mandrel 192. Finally, bore 336 communicates with a bore 338 of differential case 186. The upper end of differential case 186 includes an internal thread 340 which is connected to the measuring means 47 (see FIG. 1).

Thus, pressure of formation fluid in formation fluid flow passage 54 can be communicated to the measuring means 47 through the probe passage means 156.

Referring again to FIG. 3E, an oil retaining piston 342, which may also be referred to as a pressure sensitive retainer valve means 332, is slidably disposed in a counterbore 344 of sealing coupling 294. A coil spring 346 biases the retainer valve 342 upward toward a closed position as illustrated in FIG. 3E wherein an upper extension 348 of retainer valve 342 isolates angled passage 326 of probe passage means 156 from bore 330 of probe passage means 156.

When the probe 46 is initially assembled, the probe passage means 156 above the retainer valve 342 is filled with a hydraulic fluid such as oil. As the probe 46 is lowered into the well 10, the increasing hydrostatic pressure of the fluid within the well 10 will act downward upon the retainer valve 342 and ultimately will move the retainer valve 342 downward compressing spring 346 so as to communicate angled passage 326 with bore 330.

The purpose of this mechanism is twofold. First, it is desired to prevent the relatively dirty fluids contained in the well bore from filling the passage means 156, since those fluids might tend to clog the various passageways and/or interfere with satisfactory operation of the measuring means 47. Additionally, if the passageway 156 were not initially filled with liquid, the air which would otherwise be present in that passageway would form a compressible gas bubble at the top of the passageway which also could interfere with suitable operation of the measuring means 47.

The spring 346 is sized such that the retainer valve means 342 will open relatively quickly as the probe 46 is lowered into the well 10. It will open long before the probe 46 reaches the tester valve apparatus 44.

The probe 46 can generally be described as having a lower probe section 350 constructed to releasably latch into the probe valve 152 so that the probe valve 152 moves with the lower probe section 350 as the probe 46 is stabbed into operable engagement with the sliding sleeve tester valve 126 and withdrawn out of engagement with the sliding sleeve tester valve 126. The probe 46 can also be said to have an upper probe section 352 with the upper and lower probe sections 352 and 350 being telescoped together.

The lower probe section 350 is comprised of the lower latch 312, the sealing coupling 294, and the sealing mandrel 248.

The upper probe section 352 is comprised of the differential case 186, the sealing case 186, the sealing case 188, the jar mandrel 192, the J-slot adapter 224, the J-slot retainer 234, the oil chamber case 238, and the metering case 242.

Figure 3D:
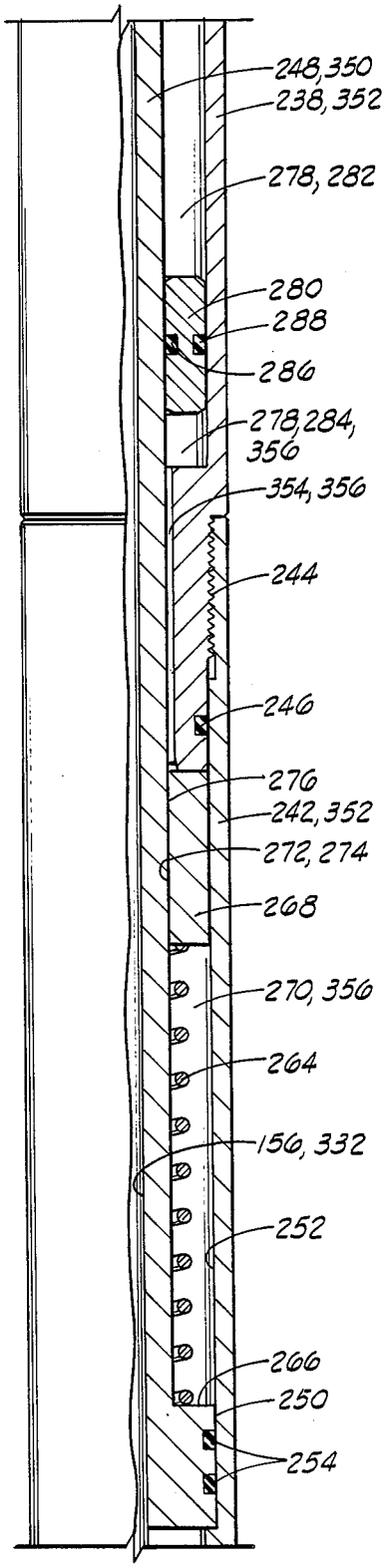
Figure 3E:
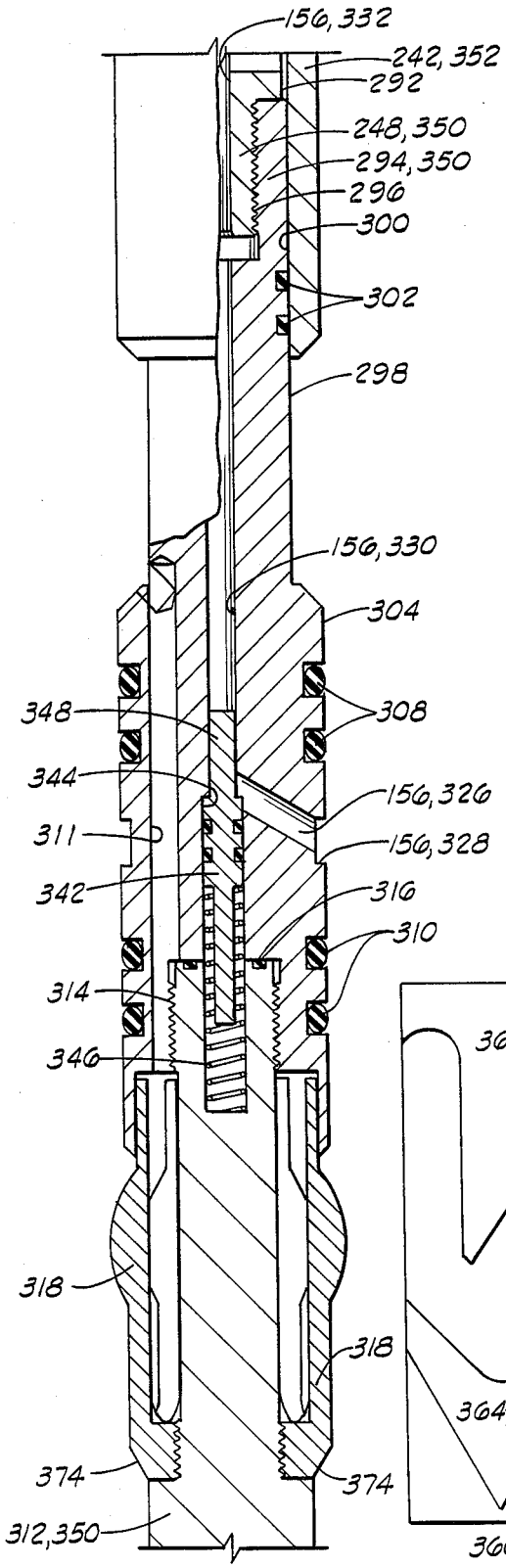
Figure 3F:
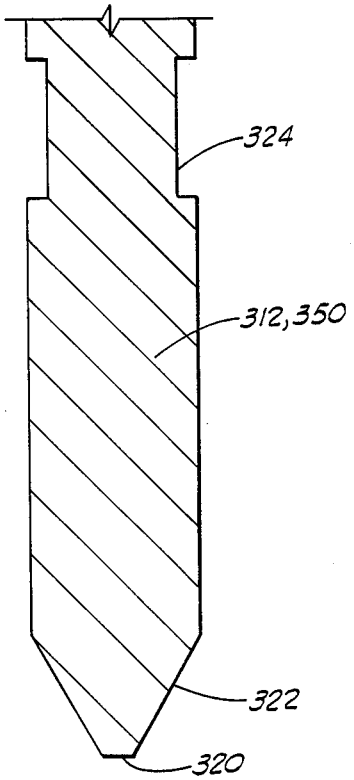

The metering spring 264 can be generally referred to as a biasing means 264 for biasing the upper and lower probe sections 352 and 350 toward a telescopingly extended position as illustrated in FIG. 3D.

The metering piston 268 can generally be referred to as a metering means 268 operably associated with the lower and upper probe sections 350 and 352 and having a restricted flow passage 272, i.e., the clearance 272, defined therethrough. The metering means 268 provides a time delay of downward movement of the upper probe section 352 relative to the lower probe section 350 determined by a time period required for a hydraulic fluid to flow through the restricted flow passage 272.

As previously mentioned, this metering means or metering piston 268 is received within an annular space 270. The annular space 270, a smaller annular space 354 located thereabove, and the lower portion 284 of annular space 278 define a metering fluid chamber 356 which is filled with a clean hydraulic fluid such as oil.

When the upper probe section 352 is forced downward relative to the lower probe section 350, as occurs when tension on the wireline 48 is slacked off, the downward movement of upper probe section 352 is retarded for a time required for the hydraulic oil in annular space 270 to meter upward through the clearance 272 into the annular spaces 354 and 284. As this occurs, the floating piston 280 moves upward displacing well fluids from the upper portion 282 of annular space 278 out through the port 290.

In a preferred embodiment of the present invention, the metering means 268 is constructed so that this metering action will take approximately one minute for the upper probe section 352 to move downward to a fully telescopingly retracted position.

When the upper probe section 352 is again pulled upward, by placing tension on the wireline 48, the upper probe section 352 will move upward relative to lower probe section 350 without any impediment from the metering means 268. The metering piston 268 itself, will initially remain in a downward position and will be slowly pushed upward by the force of the compressed spring 264, until after about a minute or so it too will return to its upwardmost position as illustrated in FIG. 3D.

The upper probe section 352 itself includes two telescoping sections which act as a wireline jar. The upper telescoping section is comprised of differential case 186 and sealing case 188. The lower telescoping section is defined by jar mandrel 192. In FIGS. 3A–3B, this telescoping jar assembly is shown in a telescopingly retracted position. It is apparent that when an upward pull is applied to wireline 48, the upper telescoping section comprised of differential case 186 and sealing case 188 will slide upward relative to jar mandrel 192 until an upward facing shoulder 376 defined on sealing case 188 abuts a downward facing shoulder 378 defined on jar mandrel 192. Thus, upward and downward motion of the wireline is applied in a jarring fashion to the jar mandrel 192.

Directing attention now to FIG. 3C and FIG. 4, the details of construction of the J-slot collar 230 will be described.

The J-slot collar 230 may generally be described as a rotatable outer collar 230 concentrically carried by the upper probe section 352.

The tester valve apparatus 44 includes a releasable connecting means 358 which operably connects the probe 46 with the sliding sleeve tester valve 126 so that the sliding sleeve tester valve 126 is moved between its open and closed positions in response to reciprocal movement of the probe 46 relative to the housing 52.

This releasable connecting means 358 includes a lug 360 (see FIG. 2B) carried on lug ring 148 of sliding sleeve tester valve 126 and a slot 362 (see FIG. 4) defined in the J-slot collar 230 of probe 46. The lug 360 is received in the slot 362 as seen for example in FIG. 5D.

Figure 4:
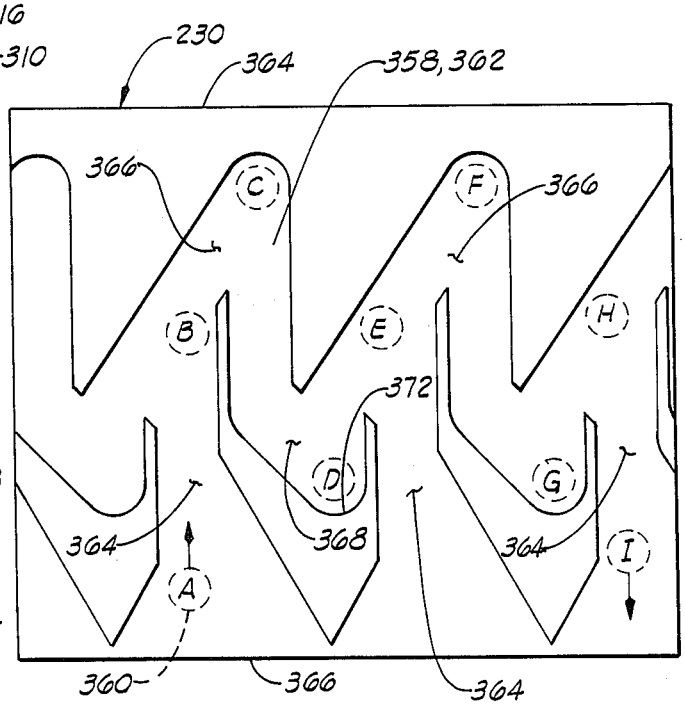
FIG. 4 is a laid-out development of the J-slot collar carried on the probe of FIG. 3C.

The J-slot collar 230 and lug 362 are best seen in a laid-out view as shown in FIG. 4. The J-slot collar 230 has upper and lower ends 364 and 366.

It is apparent in FIG. 4 that the J-slot 362 forms a repetitive endless pattern which extends around the circumference of J-slot collar 230.

Each repetitive segment of the J-slot 362 includes a tapered entry/exit region 364, an upper J portion 366, and a lower J portion 368 which communicates with the next tapered entry/exit region 364, and so on.

Each of the repetitive segments of slot 362, such as from position C to position F covers an arc of 120° so that there are three repetitive segments making up the slot 362. Preferably there are three lugs 360 spaced an angles of 120° so that the three lugs simultaneously make identical movements through similar portions of the slot 362.

For example, when the probe 46 is first stabbed into operable engagement with the sliding sleeve tester valve 126, the lug 360 would first move upward through one of the tapered entry/exit regions 364 as indicated by the position indicated in a dashed circle as A in FIG. 4.

With downward force being applied on the probe 46, the probe 46 will move downward unimpeded until the lower probe section 350 and probe valve 352 bottom out with a downward facing annular shoulder 370 (see FIGS. 2C and 5G) of probe valve 152 abutting the upward facing annular shoulder 184 of stationary pressure mandrel 64. When the probe 46 and probe valve 152 first bottom out as just indicated, further downward motion of the upper probe section 352 relative to lower probe section 350 will be impeded by the metering means 268. Just before the metering means 268 begins to move, the lug 360 will be in the position indicated as B in FIG. 4. Then, after about one minute, during which time the metering means 268 allows the upper probe section 352 to move slowly downward relative to the lower probe section 350, the lug 360 will move to the position shown as C in FIG. 4.

Then, when it is desired to open the sliding sleeve tester valve 126, an upward pull is applied to the wireline 48, thus pulling the upper probe section 352 upward so that the J-slot 362 will move upward relative to lug 360 to a position indicated as D with lug 360 abutting a lower extremity 372 of the lower J section 368 so that the upward pull is transmitted through the lug 360 to the sliding sleeve tester valve 126 to pull the same upward to an open position as illustrated in FIGS. 6A–6J.

When it is desired to reclose the sliding sleeve tester valve 126, tension is again slacked off on the wireline 48. The lug 360 will initially move to position E shown in FIG. 4, and after about one minute due to the operation of the metering means 268 will move to the position indicated as F in FIG. 4.

It will be apparent from FIG. 4 and the description just given, that the sliding sleeve tester valve 126 can be opened and closed an infinite number of times by reciprocating the probe 46 as just described so that the lug 360 moves repetitively through a path such as C-D-E-F.

When it is desired to disconnect the probe 46 from the sliding sleeve tester valve 126 so that the probe 46 can be withdrawn out of engagement with the tester valve apparatus 44, the tester valve 126 must first be moved to an open position by pulling upward on the wireline 48 so as to move the lug 360 to a position such as indicated as G in FIG. 4. This position should be held for at least one minute so that the metering means 268 can return to its upward position as shown in FIG. 3D. Also the flowing well will carry away any debris which may have collected to top of probe 46.

Then, tension is slacked off the wireline 48 so that the lug 360 moves to a position as indicated at H, and then rapidly before the metering means 268 allows the lug 360 to move on upwards within slot 362, tension is applied to wireline 48 causing the lug 360 to move downward through the entry/exit region 364 such as indicated in position I thus allowing the probe 46 to be withdrawn.

The slot 362 can be generally described as defining a primary operating paths such as C-D-F-G, etc., which causes the sliding sleeve tester valve 126 to be moved between its open and closed positions in response to reciprocation of the probe 46 relative to the housing 52. The slot 362 can also be described as defining an alternative connect/disconnect path, namely the tapered entry/exit regions 364, which allows the probe 46 to be selectively stabbed into operable engagement with the sliding sleeve tester valve 126 and withdrawn out of engagement with the sliding sleeve tester valve 126.

The metering means 268 can generally be described as a selection means 268 operably associated with the releasable connecting means 358 for causing the lug 360 to move from its primary path C-D-F-G, etc., into the alternative connect/disconnect path 364 in response to an appropriately timed reciprocal motion of the probe 46 relative to the housing 52 as previously described.

This selection means or metering means 268 is a time delay means 268 for retarding downward motion of the probe 46 relative to housing 52 while permitting unretarded upward motion of the probe 46 relative to housing 52.

It is further apparent from FIG. 4 that the primary operating path C-D-F-G, etc., is an endless path so that the sliding sleeve tester valve 126 may move an infinite number of times between its open and closed positions.

The reversing nipple 66 includes a hollow shear plug 380 (FIG. 2E) which is threadably attached to reversing nipple 66. If it is desired to reverse the circulation in the well 10, i.e., that is to pump fluid down the annulus 32 and up through the interior 36 of pipe string 28, this can be accomplished by first dropping a weighted bar down through the interior 36 so that it strikes shear plug 380 shearing the same and allowing the hollow plug passage 282 to communicate the annulus 32 with the interior 36 of pipe string 28. The sheared off components, and the drop bar will be caught in the bar catching mandrel 68 shown in FIG. 2F.

Methods Of Operation

Referring now to FIGS. 1, 4, 5A–5J and 6A–6J, the methods of operation of the present invention will be described.

In FIG. 1, the probe 46 is being lowered downward toward the tester valve apparatus 44. The probe 46 and tester valve apparatus 44 each individually have their components initially arranged as shown in FIGS. 3A–3F and 2A–2F, respectively.

FIGS. 5A–5J depict the entire well testing apparatus 50 after the probe 46 has been stabbed into the tester valve apparatus 44, and the probe 46 and probe valve 152 have bottomed out and sufficient time has passed for the upper probe section 350 to move downward relative to lower probe section 352, thus placing the lug 360 in a position such as shown in C in FIG. 4.

FIGS. 6A–6J depict the well testing apparatus 50 in a position wherein the probe 46 has been pulled upward to pull the sliding sleeve tester valve 126 to an open position, with the lug 360 being in a position as indicated at D in FIG. 4. A sufficient time has passed for spring 264 to push metering piston 268 to an upward position.

As the probe 46 is lowered into engagement with the tester valve apparatus 44, the lower probe section 350, and particularly the lower latch 312 and outer cylindrical surface 304 of sealing coupling 294 will pass very freely down through the central axial passageway of tester valve apparatus 44 until the lower probe section 350 begins to move into the bore 306 of probe valve 152. It is noted that the probe valve 152 is initially locked in its closed position as illustrated in FIGS. 2C–2D by the action of the pivotable latches 174.

As the lower probe section 350 moves downward into the bore 306 of probe valve 152, the upper ends of centering springs 318 are cammed inward by engagement with bore 306 and then lower outer cam surfaces 374 of centering springs 318 wedge under cam surfaces 376 (see FIG. 2C) of the upper ends of pivotable latches 174 so as to tip the upper ends of pivotable latches 174 outward thus tipping the latch lugs 182 inward out of engagement with the shoulder 184 and into engagement with the groove 324 in lower latch 312 thus latching the lower probe section 350 and probe valve 152 together.

Then, the probe 46 and probe valve 152, now latched together by latch lugs 182, move downward together relative to housing 52 until the shoulder 370 of probe valve 152 bottoms out against shoulder 184 of stationary pressure mandrel 64 as illustrated in FIG. 5G. Further downward force applied to the probe 46 then, over a period of a minute or more, causes the upper probe section 352 to telescope downward over the lower probe section 350 as controlled by the metering neans 268. This final downward position is illustrated in FIGS. 5A–5J.

When the probe 46 is so lowered into the engagement with the sliding sleeve tester valve 126 of tester valve apparatus 44 as just described, the probe 46 and sliding sleeve tester valve apparatus 126 are releasably connected together by the releasable connecting means 358 comprised of lug 360 and slot 362.

When the probe valve 152 moves downward to its open position as shown in FIGS. 5F–5G with the probe passage means 156 communicated with the formation fluid flow passage means 54, the fluid property measuring means 47 carried by the probe 46 is communicated with the formation fluid flow passage 54 of the tester valve apparatus 44. In the position shown in FIGS. 5F–5G, the communication of probe passage means 156 with flow passage 54 occurs through ports 158 and 164 and a small annular clearance 384 between the bore of stationary pressure mandrel 64 and the outer surface of probe valve 52. The clearance 384 communicates ports 158 and 164.

Then, the probe 46 can be reciprocated to open and close the sliding sleeve tester valve 46 of tester valve apparatus 44 and provide flowing and shut-in conditions for measurement by the fluid property measuring means 47 carried on probe 46.

Figure 5A:
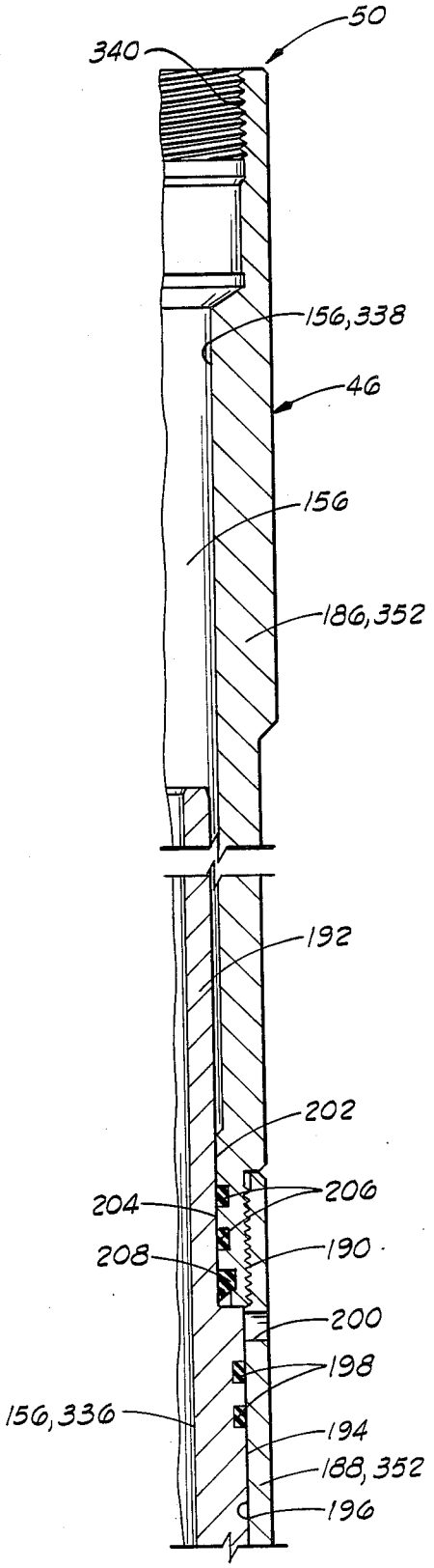
FIGS. 5A–5J comprise an elevation sectioned view of the probe of FIGS. 3A–3F in place within the tester valve apparatus of FIGS. 2A–2F. The tester valve apparatus is in a closed position. The lower section of the probe and the probe valve have bottomed out within the housing, and sufficient time has passed to allow fluid to meter through a restricted orifice so that the upper section of the probe is shown in its lowermost position. The probe valve is in an open position communicating the flow passage of the housing with the probe passage of the probe.
Figure 5B:
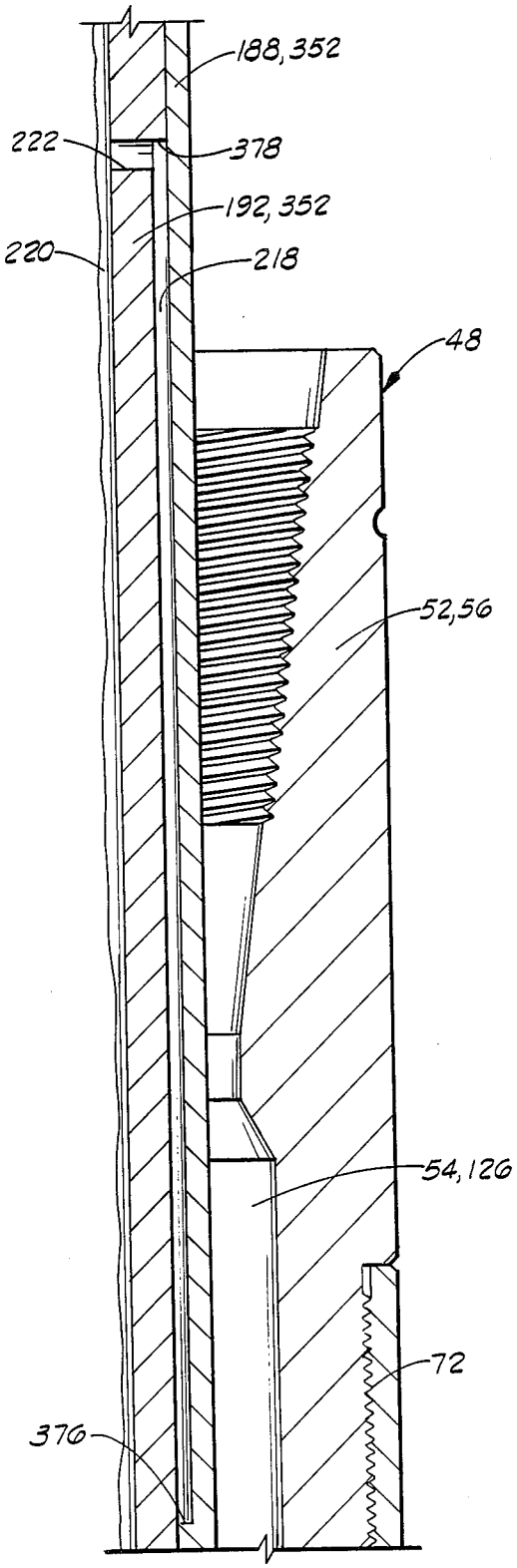
Figure 5C:
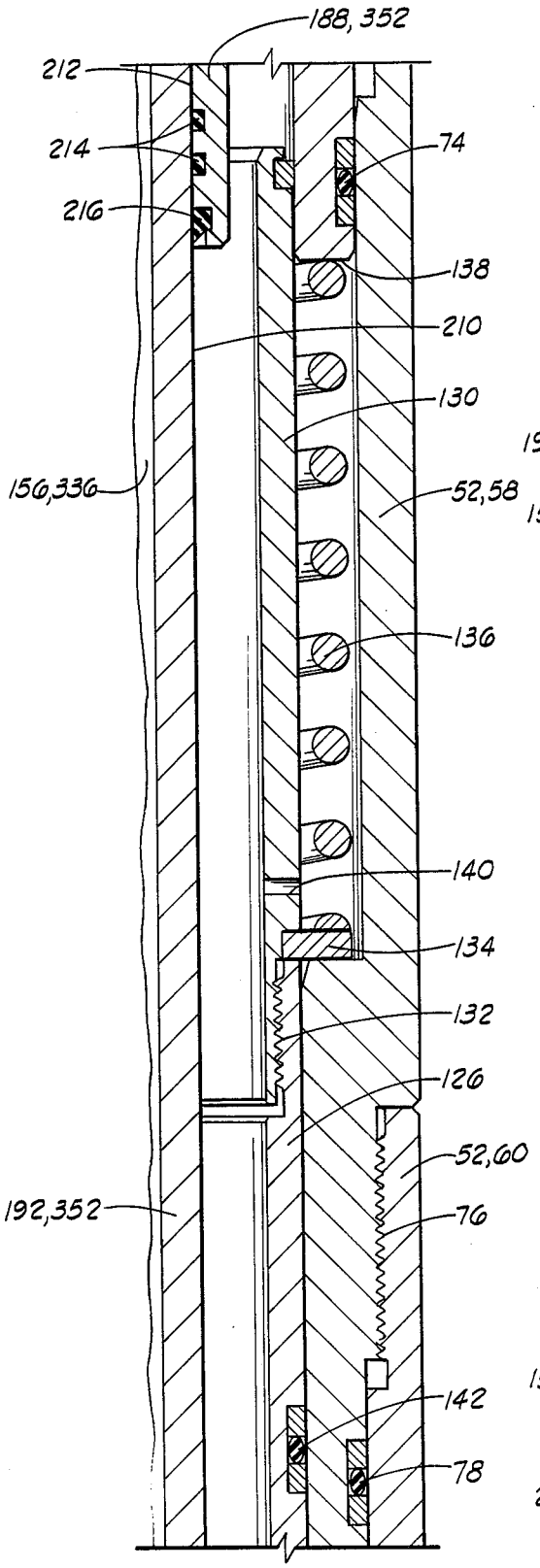
Figure 5D:
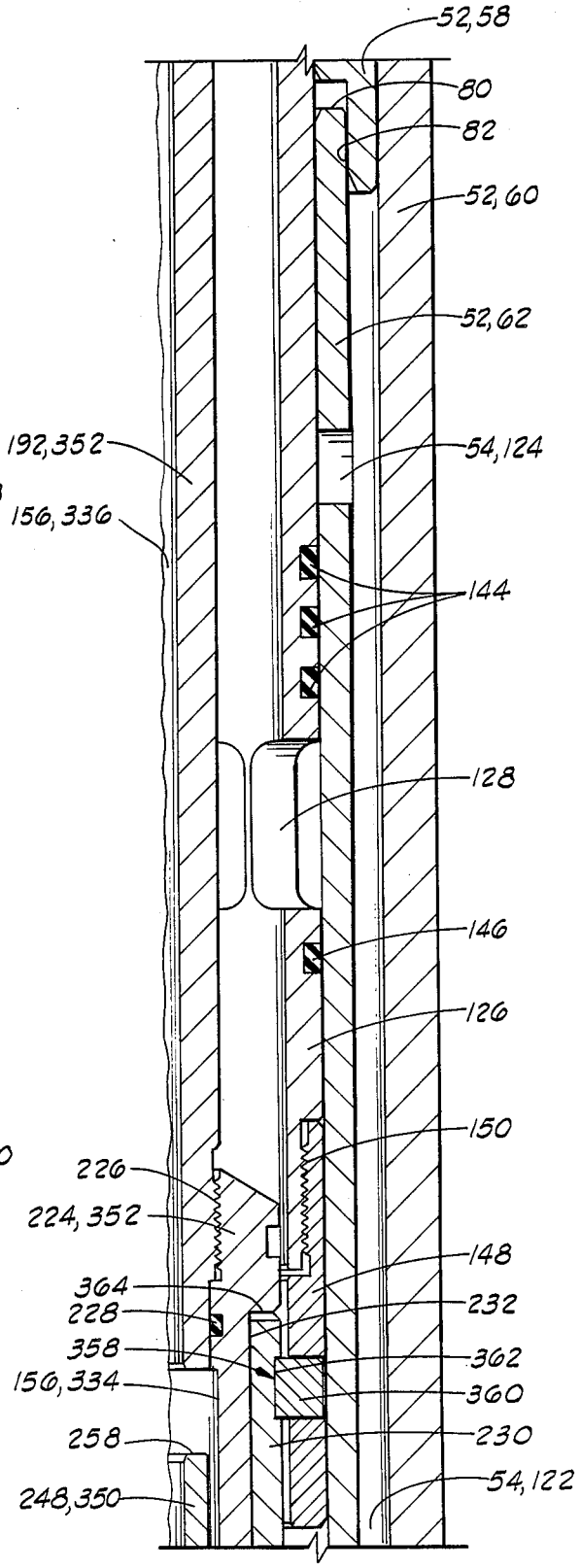
Figure 5E:
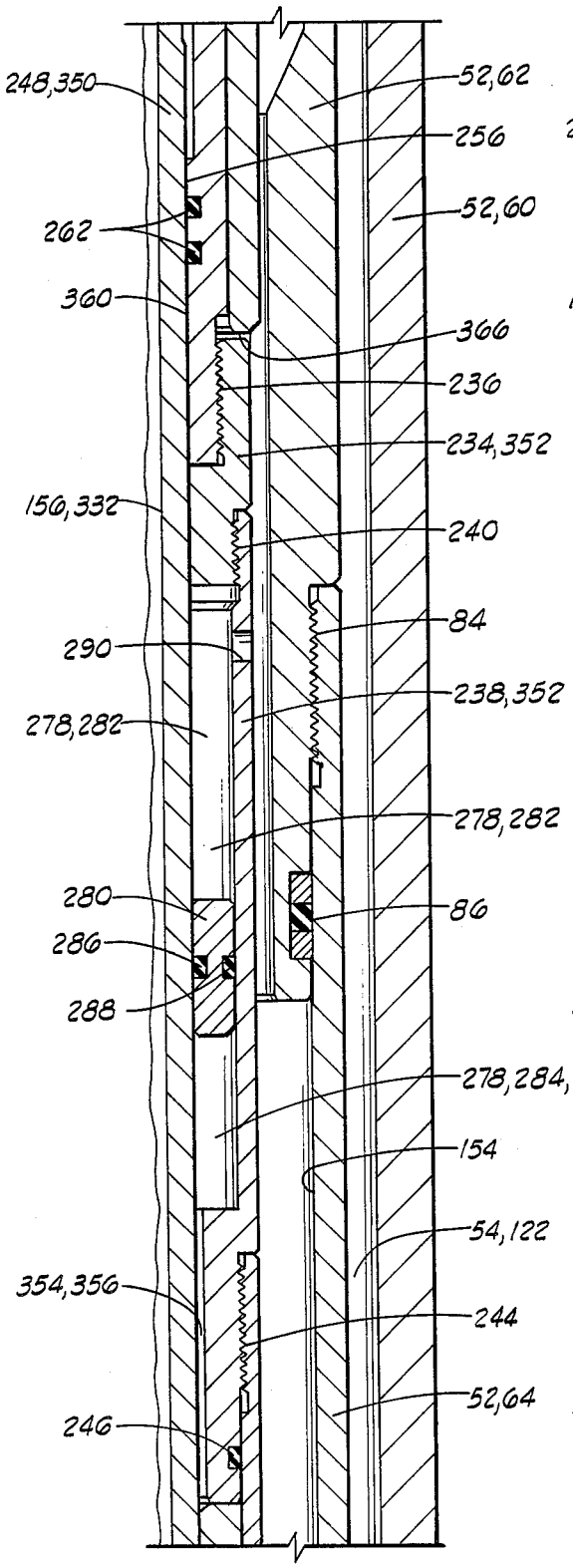
Figure 5F:
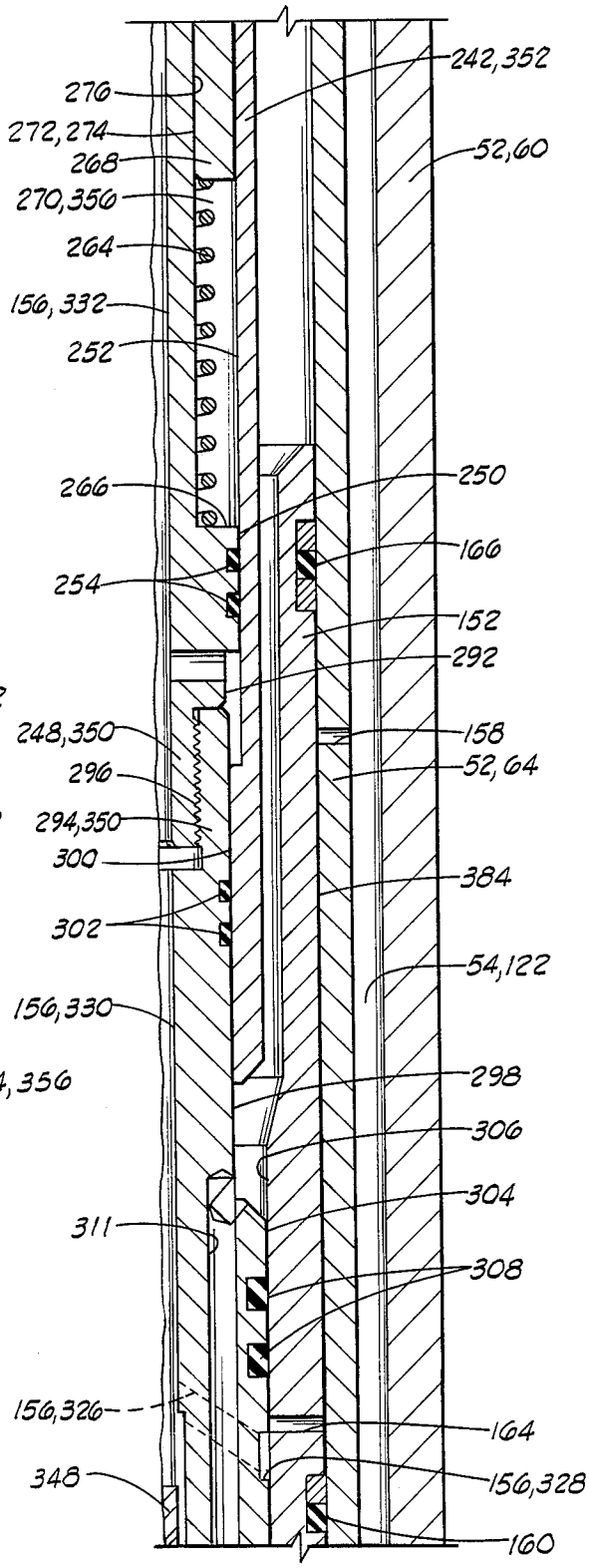
Figure 5G:
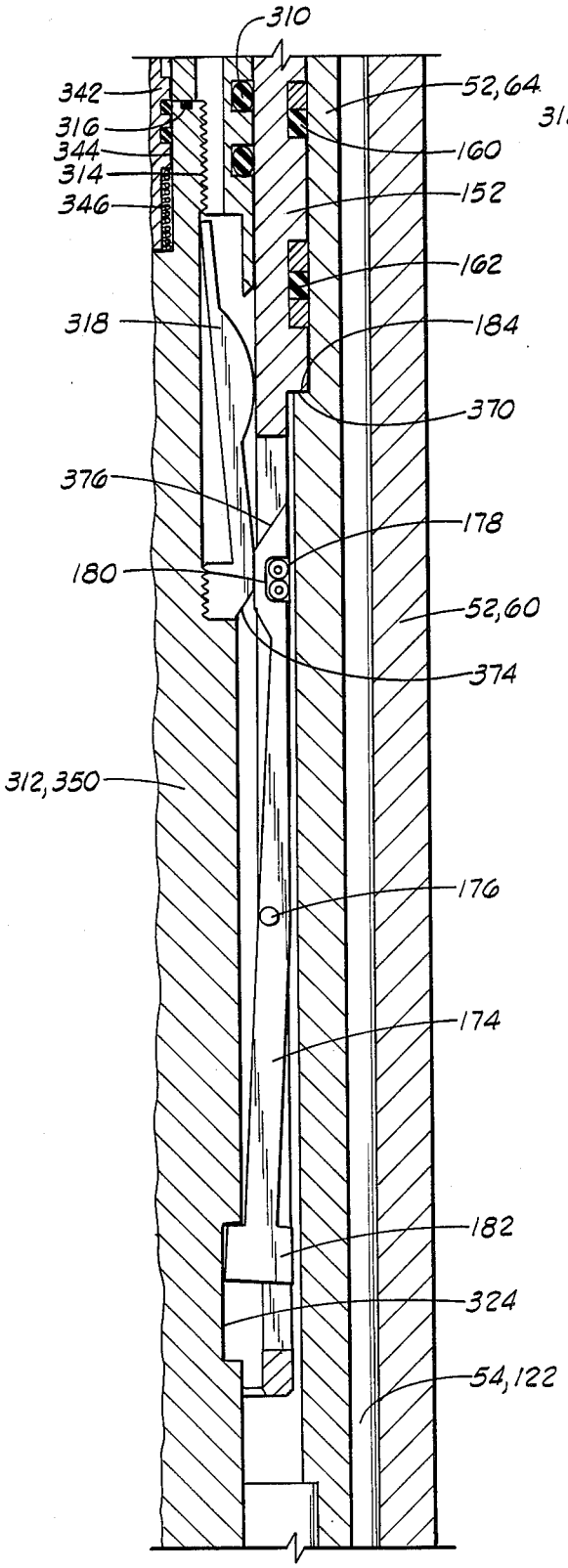
Figure 5H:
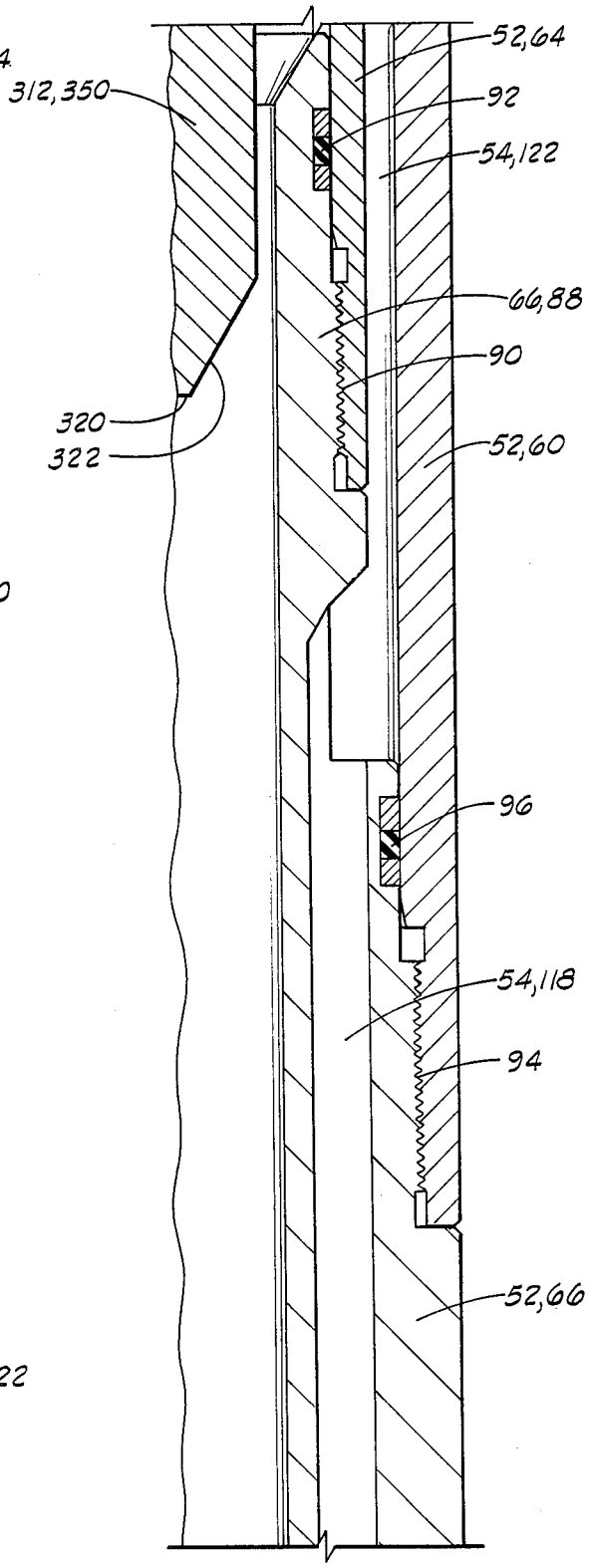
Figure 5I:
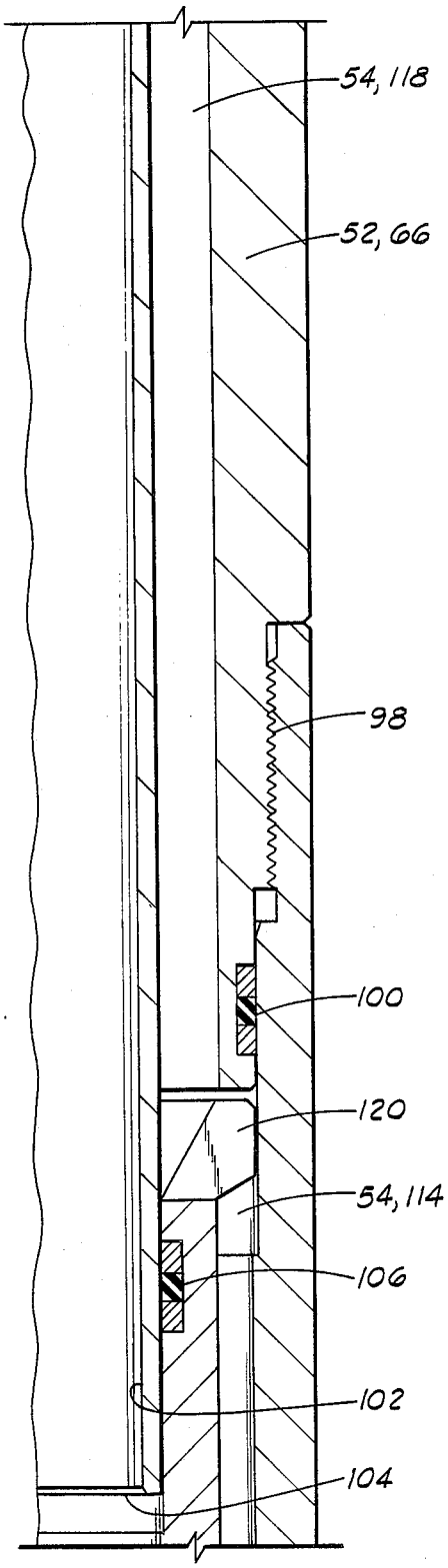
Figure 5J:
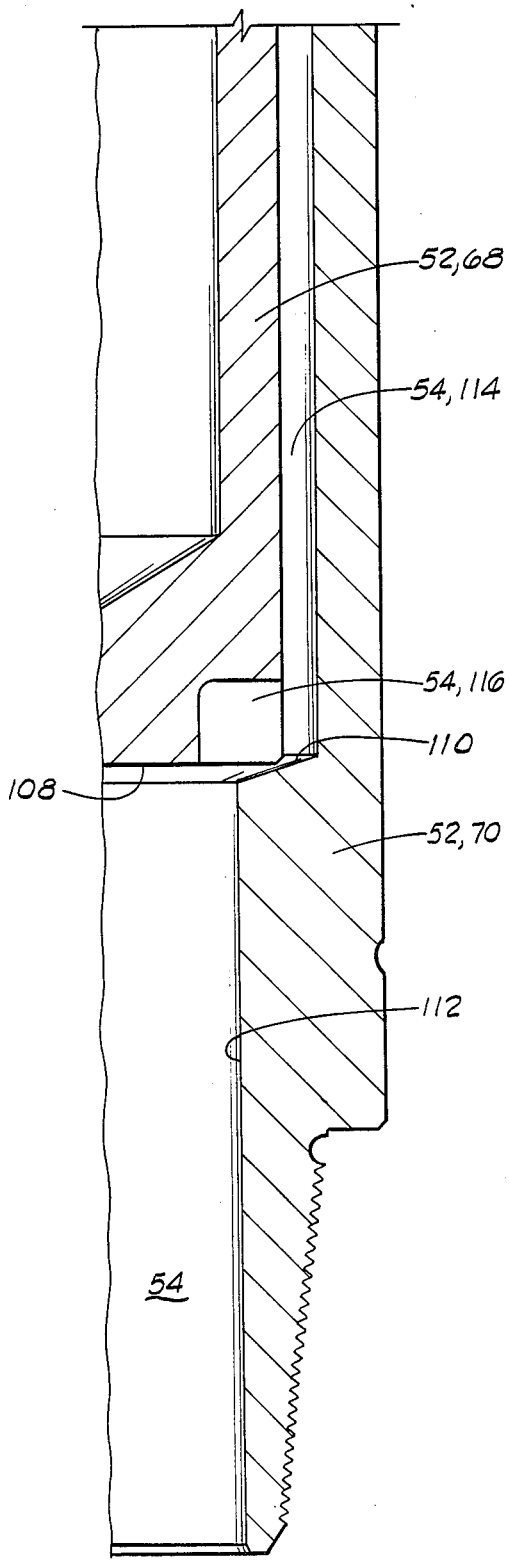
Figure 5A:
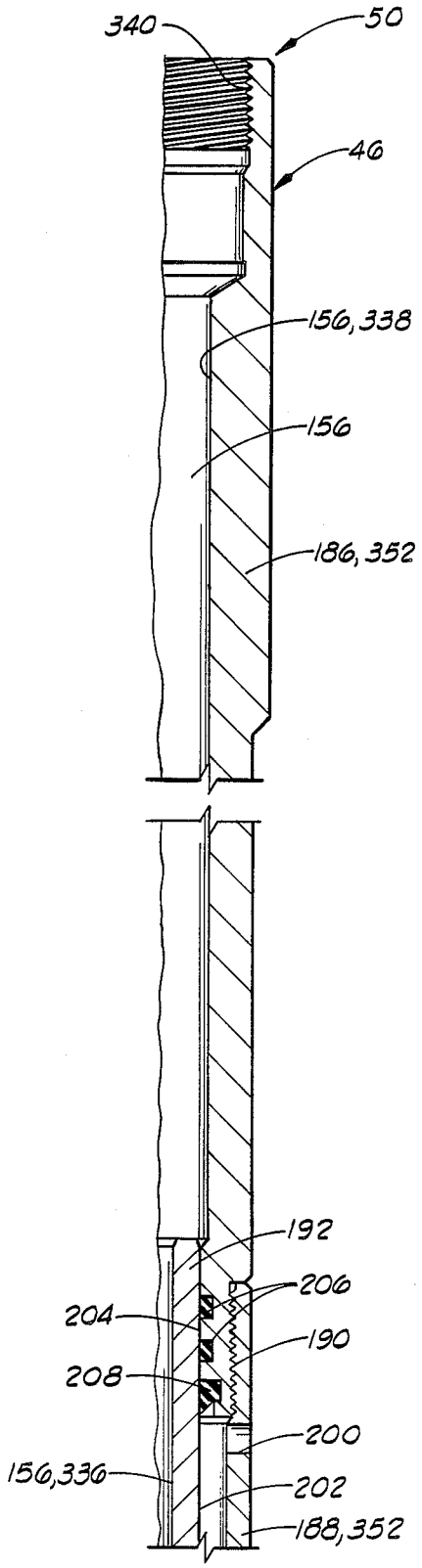
Figure 5B:
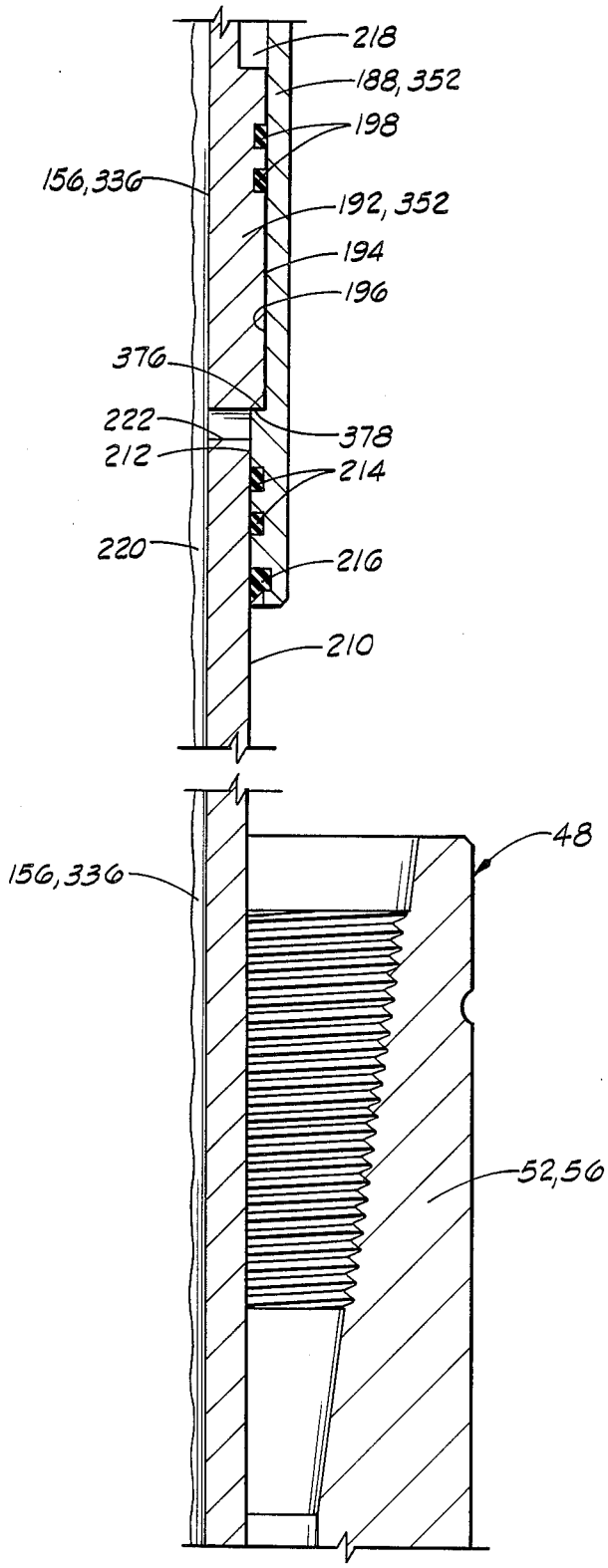
Figure 5C:
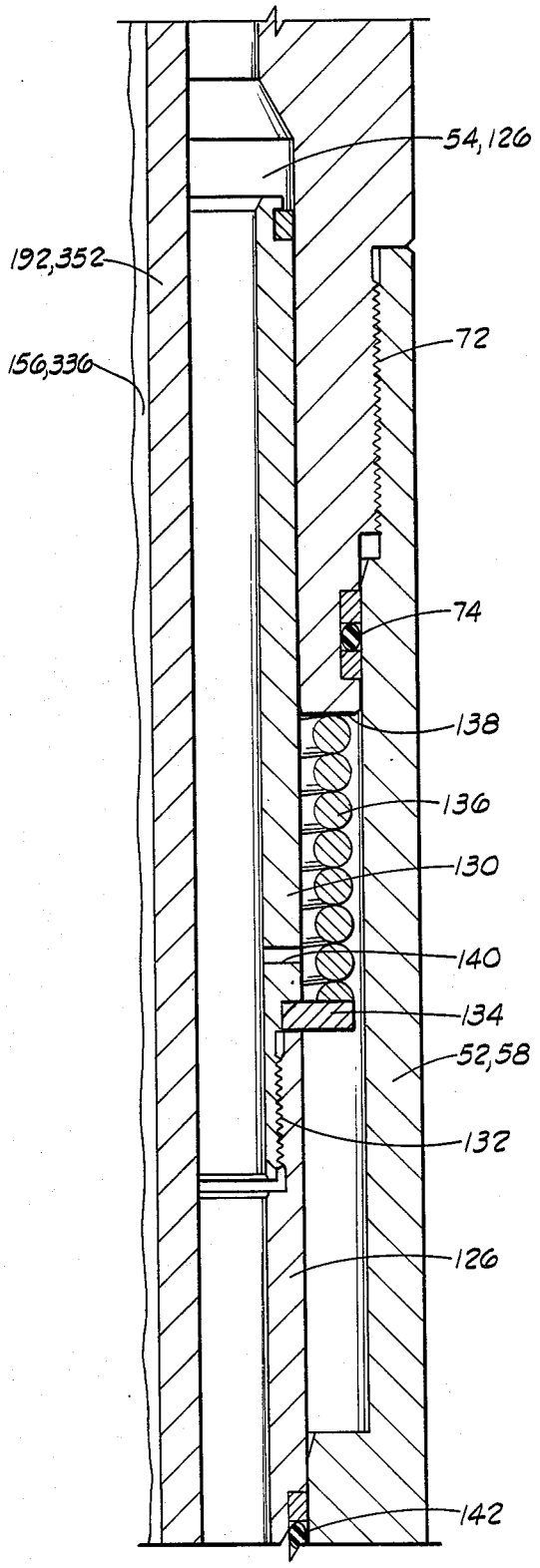
Figure 5D:
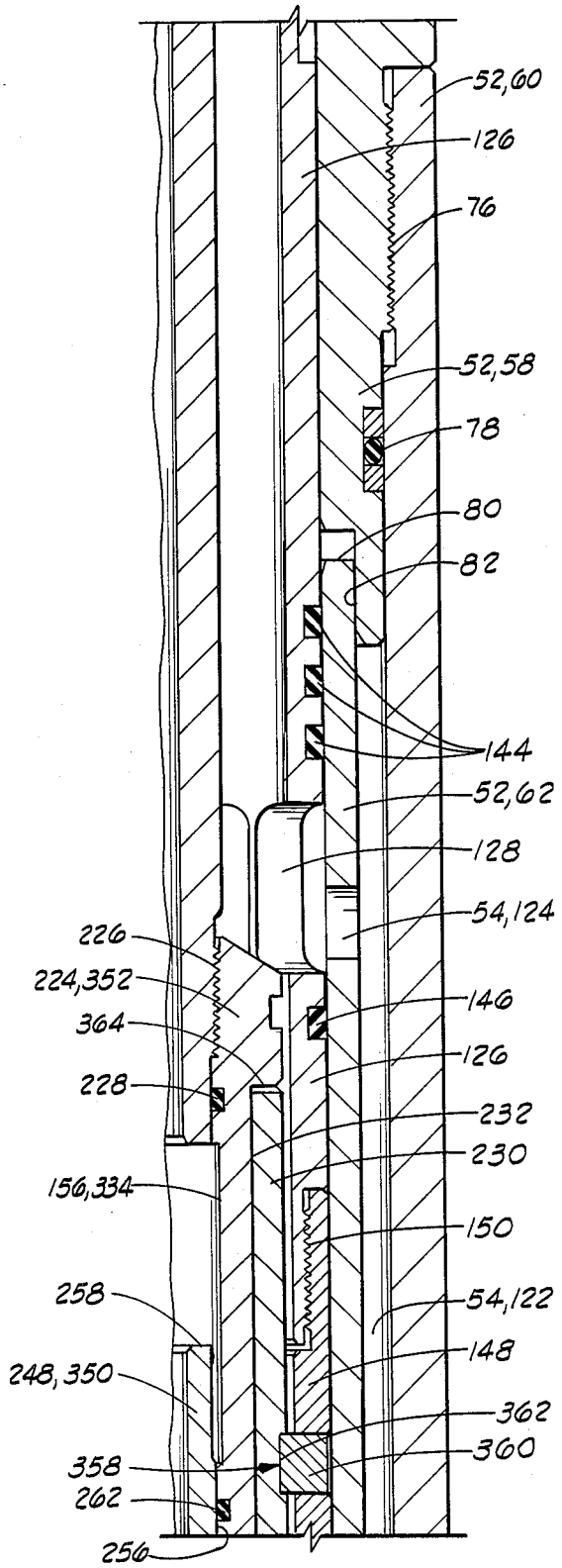
Figure 5E:
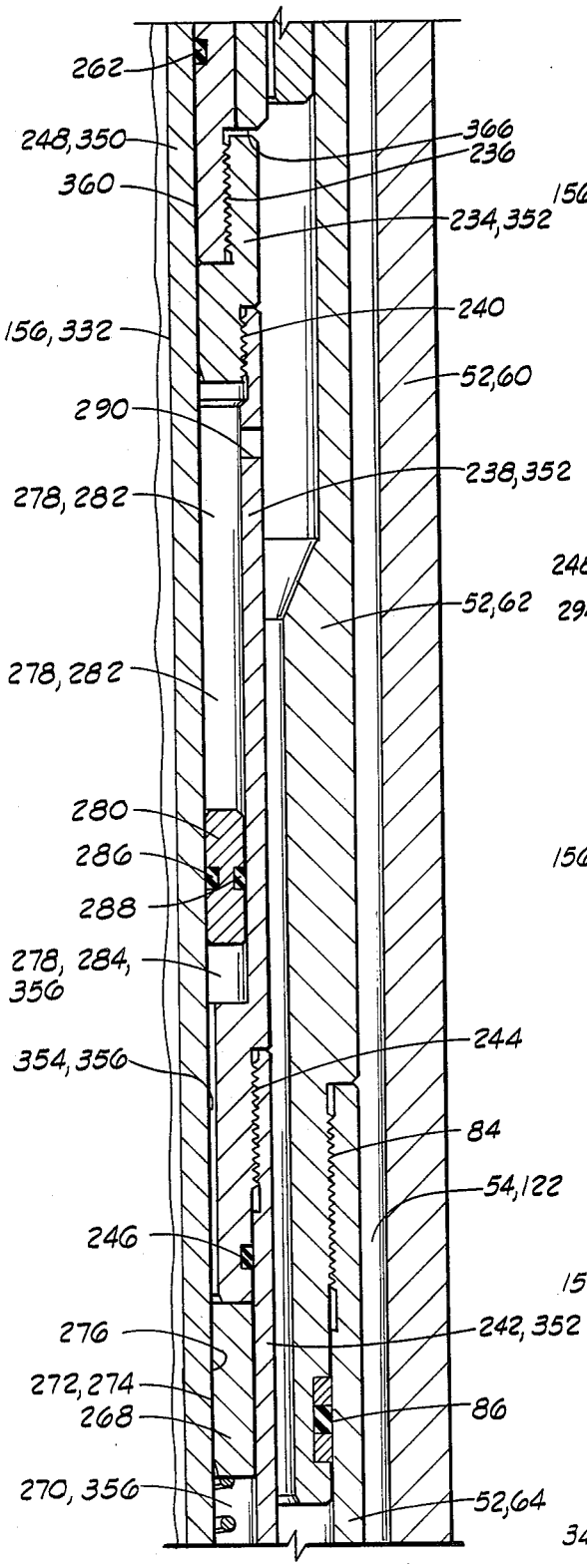
Figure 5F:
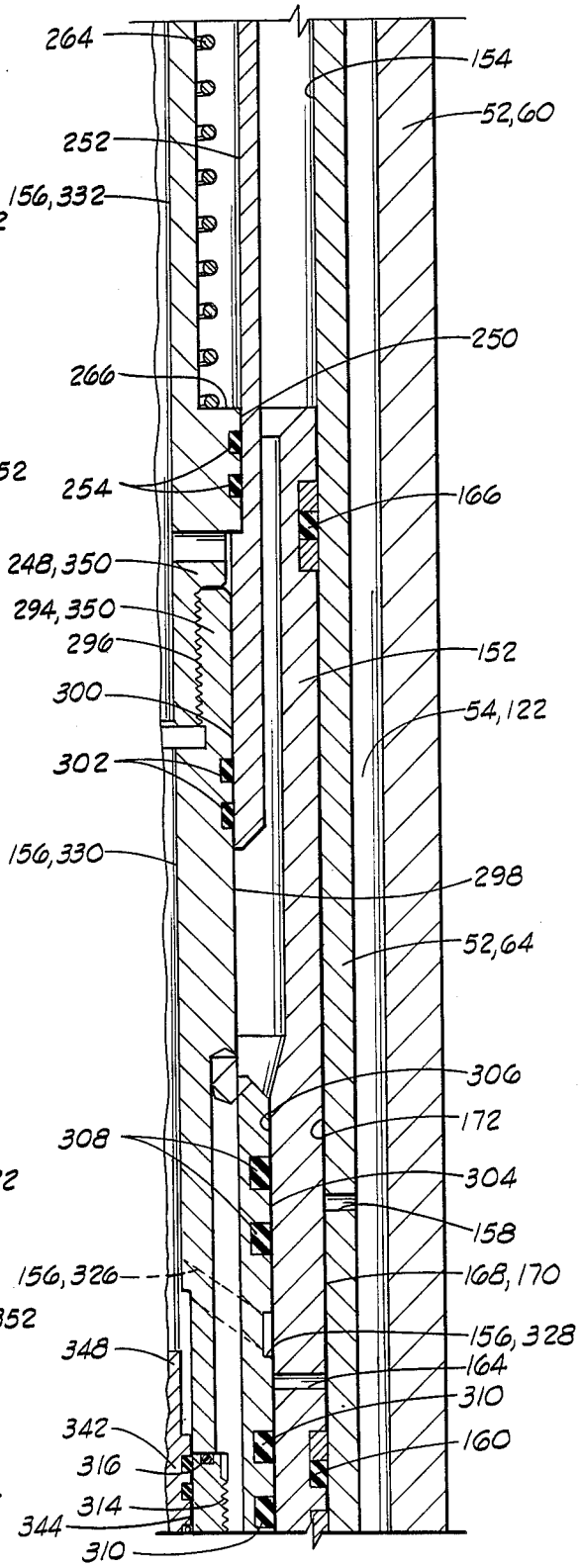
Figure 6G:
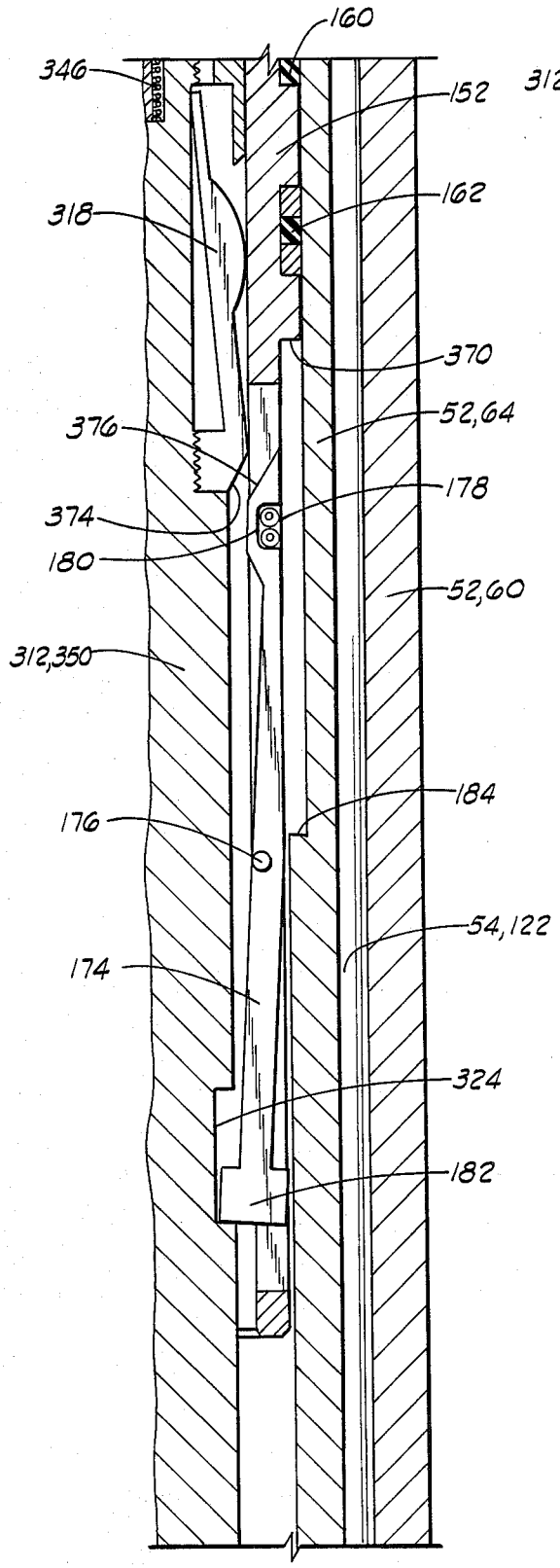
Figure 6H:
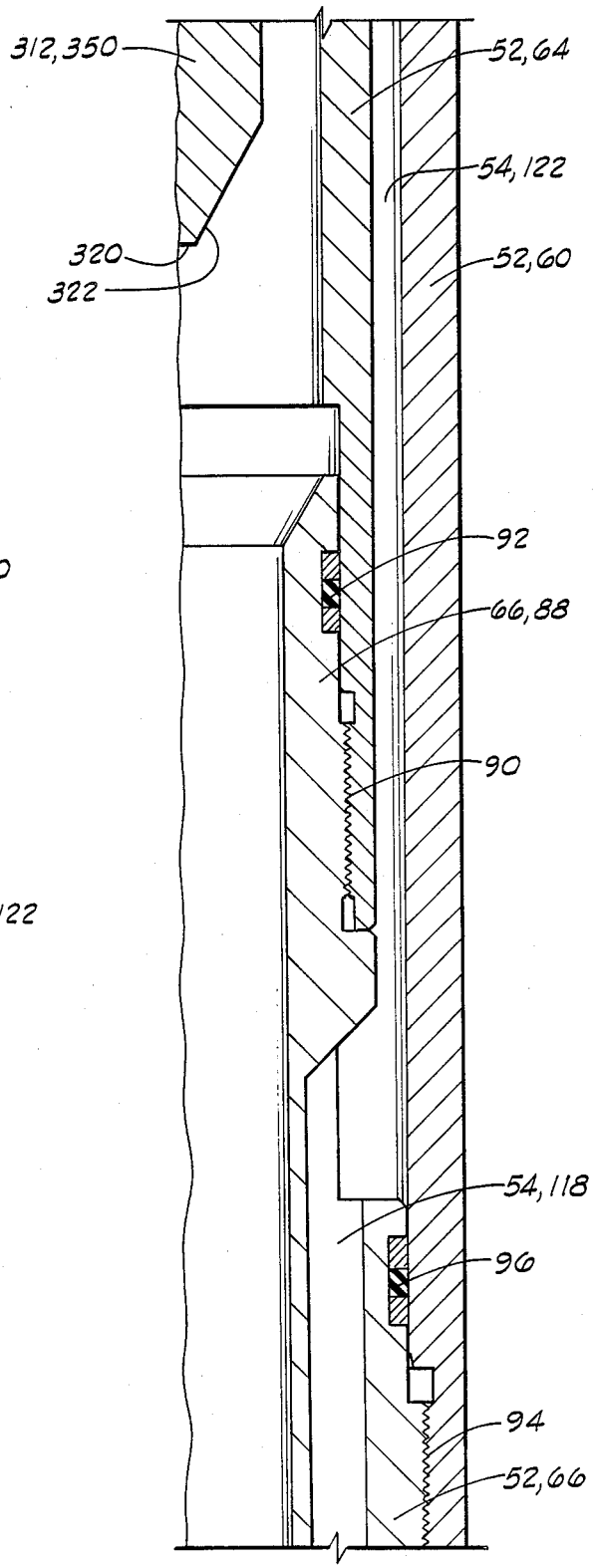
Figure 5I:
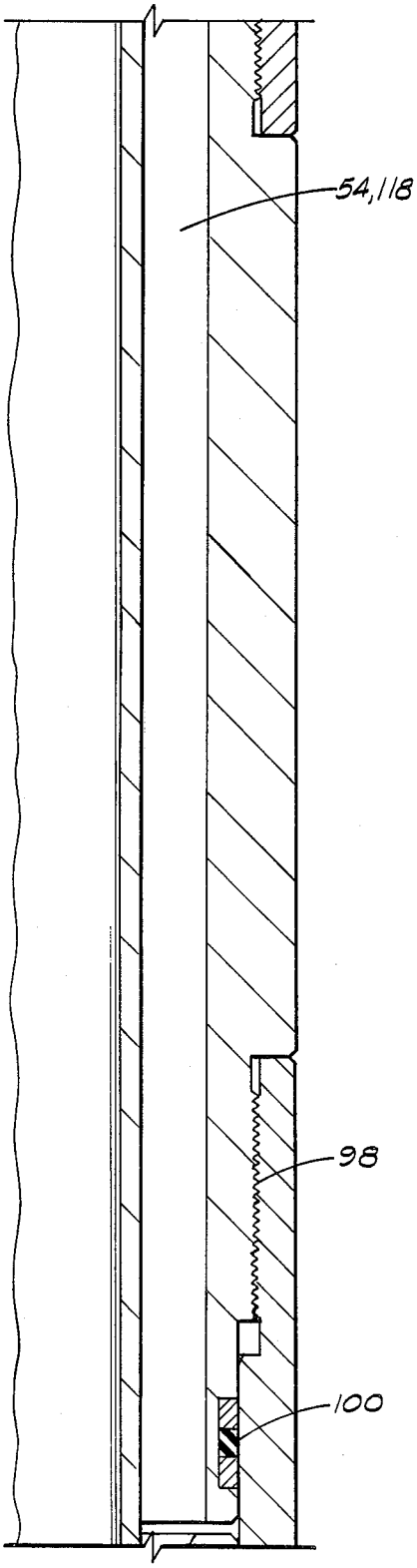
Figure 5J:
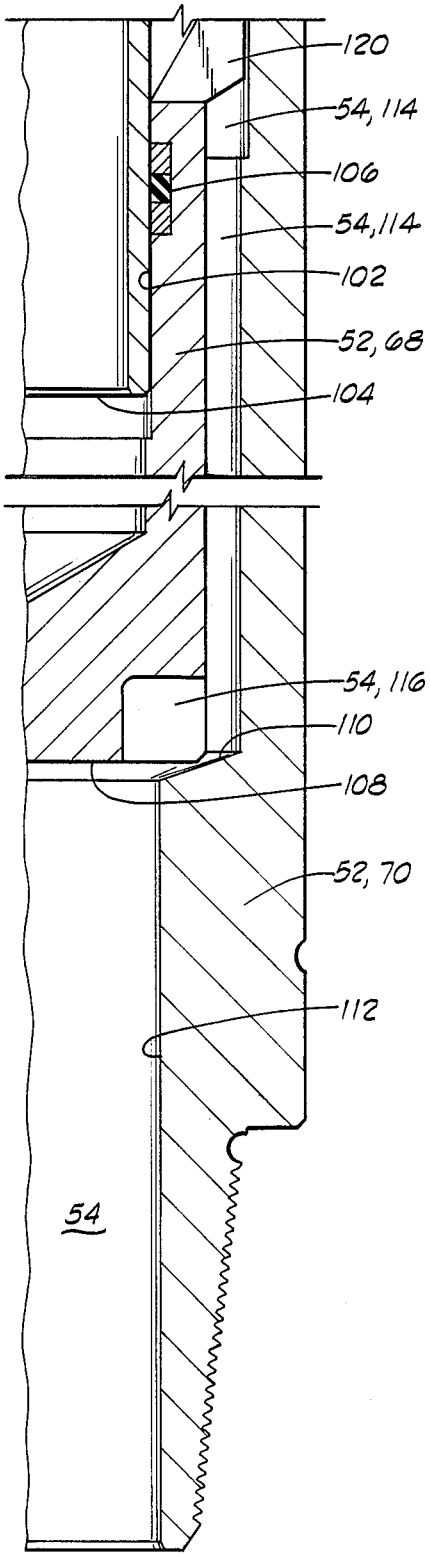

As previously indicated, when the probe 46 is in the position shown in FIGS. 5A–5J, the lug 360 will be located as shown in position C in FIG. 4, and the sliding sleeve tester valve 126 will be in a closed position as best seen in FIG. 5D.

By pulling upward on the wireline 48 to cause the probe 46 to move through an upward stroke of its reciprocal motion, the various components of well testing apparatus 50 will move from the position of FIG. 5A–5J to the position of FIG. 6A–6J. This occurs as follows.

As an upward pull is applied to the wireline 48, the upper probe section 350 including the J-slot collar 230 move upward relative to the lug 360 until the lug 360 bottoms out in a position as shown as D in FIG. 4. Further upward pull on the wireline 48 pulls the sliding sleeve tester valve 126 upward relative to housing 52 compressing the spring 136 until the sliding sleeve tester valve 126 is moved to the open position best seen in FIG. 6D wherein the windows 128 of sliding sleeve tester valve 126 are aligned with the valve ports 124 thus allowing flow of formation fluids upward through the formation fluid flow passage 54 of housing 52.

As prevously described, the sliding sleeve tester valve 126 may be repeatedly moved between its open and closed positions any number of times by reciprocating the probe 46 relative to the housing 52.

During each reciprocation of the probe 46, i.e., during the cycle of one complete upward and downward movement of probe 46, this movement of the probe 46 is retarded during a portion of the downward stroke of probe 46 relative to housing 52. This retarding force is provided by the metering means 268 previously described.

During any reciprocation of the probe 46, the probe 46 can be disconnected from the tester valve apparatus 44 by rapidly reversing the direction of the probe 46 from a downward motion to an upward motion before the metering means 268 permits the lug 360 to move from a position such as B or E to a position such as C or F.

It is apparent from viewing FIGS. 5F and 6F that when the tester valve apparatus 126 is in either of its open and closed positions, the probe valve 152 remains in an open position. Thus, the fluid property measuring means 47 is communicated with the formation fluid flow passage 54 during both open flow and shut-in conditions of the well 10.

Also, the probe 46 can be unlatched and pulled out of operative engagement with the tester valve apparatus 44 and then subsequently lowered and relatched into operative engagement with the tester valve apparatus 44 without first completely removing the probe 46 from the well 10.

It should be noted that the general concept of the releasable connecting means 358 is of course applicable to well tools other than a surface read-out tester valve apparatus. It can generally be used in any situation where it is desired to provide a positive but releasable connection between first and second elements of a tool, and where it is desired to reciprocate those elements between a plurality of operating positions. For example, the general design of the releasable connecting means 358 could be incorporated in other tools such as a reversing valve or a surface read-out pressure transmitting valve, or many others with different operating sequences.

Thus it is seen that the apparatus and methods of the present invention readily achieve the ends and advantages mentioned as sell as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A well tool apparatus, comprising:

a first element;

a second element, operably associated with said first element, said second element being arranged relative to said first element for reciprocal motiion therebetween;

a J-slot means, operably associated with said first and second elements, for controlling said relative reciprocal motion between said first and second elements, said J-slot means including:

a slot associated with one of said first and second elements, said slot defining at least a first and a second path, said first and second paths being alternative to each other; and a lug associated with the other of said first and second elements, said lug being received in said slot for selective movement along either of said first and second paths; and time delay means, operably associated with said first and second elements, for retarding said relative reciprocal motion between said first and second elements and for thereby causing said lug to selectively move into a preferred one of said first and second paths of said slot in response to an appropriate timing of said relative reciprocal motion.

2. The apparatus of claim 1, wherein:

said J-slot means is further characterized in that said first path of said slot defines an operating mode of said apparatus wherein said first and second elements may reciprocate between a plurality of operating positions, and said second path of said slot permits said first and second elements to be connected to and disconnected from each other.

3. The apparatus of claim 2, wherein:

said J-slot means is further characterized in that said first path of said slot is an endless path so that said first and second elements may reciprocate relative to each other an infinite number of times while said lug remains in said first path of said slot.

4. The apparatus of claim 1, wherein:

said time delay means is further characterized as a means for retarding relative reciprocal motion between said first and second elements in a first direction and permitting unretarded relative reciprocal motion in a second direction opposite said first direction.

5. The apparatus of claim 4, wherein:

said first and second elements are tubular elements, one being telescopingly received within the other; and said time delay means retards telescopingly collapsing motiion between said first and second elements and permits unretarded telscopingly extending motion.

6. The apparatus of claim 1, wherein:

said time delay means is a hydraulic time delay means for metering a hydraulic fluid through a restricted opening.

7. A well testing apparatus, comprising:

a housing having a formation fluid flow passage defined therethrough;

a sliding sleeve tester valve reciprocably disposed in said housing and movable between an open position wherein said flow passage is open and a closed position wherein said flow passage is closed;

a probe, separable from said housing and constructed to be received coaxially within said sliding sleeve tester valve, said probe having a probe passage means defined therein for communicating said formation fluid flow passage with a measuring means to be carried on said probe;

a probe valve disposed in said housing, said probe valve being constructed to receive a lower end of said probe therein, and said probe valve being movable between an open position wherein said flow passage of said housing is communicated with said probe passage means, and a closed position wherein said flow passage is isolated from said probe passage means;

releasable connecting means for operably connecting said probe and said sliding sleeve tester valve so that said sliding sleeve tester valve is moved between its said open and closed positions in response to reciprocal movement of said probe relative to said housing; and wherein said housing, said sliding sleeve tester valve, said probe, said probe valve and said connecting means are so arranged and constructed that when said probe is connected to said tester valve by said connecting means, and said tester valve is in either of said open and said closed positions, said probe valve remains in its said open position.

8. The apparatus of claim 7, wherein said releasable connecting means comprises:

a lug associated with one of said probe and said sliding sleeve tester valve; and a slot associated with the other of said probe and said sliding sleeve tester valve, said lug being received in said slot, said slot defining a primary operating path which causes said tester valve to be moved between its said open and closed positions in response to reciprocation of said probe relative to said housing, and said slot defining an alternative connect/disconnect path which allows said probe to be selectively stabbed into operable engagement with said sliding sleeve tester valve and withdrawn out of engagement with said sliding sleeve tester valve.

9. The apparatus of claim 8, further comprising:

selection means, operably associated with said releasable connecting means, for causing said lug to move from said primary path into said alternative connect/disconnect path.

10. The apparatus of claim 9, wherein:

said selection means is further characterized as a means for causing said lug to move from said primary path into said alternative connect/disconnect path in response to an appropriately timed reciprocal motion of said probe relative to said housing.

11. The apparatus of claim 10, wherein:

said selection means is further characterized as a time delay means for retarding said reciprocal motion of said probe relative to said housing.

12. The apparatus of claim 11, wherein:

said time delay means retards downward motion of said probe relative to said housing and permits unretarded upward motion of said probe relative to said housing.

13. The apparatus of claim 8, wherein:

said primary operating path of said slot is an endless path so that said sliding sleeve tester valve may move an infinite number of times between its open and closed positions.

14. The apparatus of claim 8, wherein:

said sliding sleeve tester valve is disposed in an upper portion of said housing;

said probe valve is disposed in a lower portion of said housing below said sliding sleeve tester valve; and said probe extends axially through said sliding sleeve tester valve and downward below said tester valve into engagement with said probe valve.

15. The apparatus of claim 14, wherein said probe comprises:

a lower probe section constructed to releasably latch into said probe valve so that said probe valve moves with said lower probe section relative to said housing as said probe is stabbed into operable engagement of said sliding sleeve tester valve and withdrawn out of engagement with said sliding sleeve tester valve;

an upper probe section, said upper and lower probe sections being telescoped together;

biasing means for biasing said upper and lower probe sections toward a telescopingly extended position;

a rotatable outer collar concentrically carried by said upper probe section, said collar having said slot of said releasable connecting means defined therein;

a metering means, operably associated with said lower and upper probe sections, said metering means having a restricted flow passage defined therethrough, for providing a time delay of downward movement of said upper probe section relative to said lower probe section determined by a time period required for a hydraulic fluid to flow through said restricted flow passage; and wherein said apparatus is so arranged and constructed that when said probe is moved downward relative to said housing to move said tester valve between its said open and closed position said upper and lower probe sections move downward together relative to said housing unimpeded by said metering means until said lower probe section bottoms out, and then said upper probe section continues a slower impeded downward movement relative to both said housing and said lower probe section, said alternative connect/disconnect path of said slot being accessible by a rapid reversal of direction of said upper probe section immediately after said lower probe section bottoms out.

16. The apparatus of claim 7, wherein:

said probe includes a pressure sensitive retainer valve means, operably associated with said probe passage means, for initially retaining a liquid in said probe passage means when said probe is first placed in a well.

17. A method of measuring a property of formation fluid in a well, said method comprising the steps of:

(a) providing a tester valve and probe assembly, said tester valve being constructed to be assembled with a pipe string of said well and said probe being separable from said tester valve, said assembly including a releasable connector connecting said probe and said tester valve so that said tester valve is moved between open and closed positions thereof in response to reciprocation of said probe;

(b) lowering said probe into engagement with said tester valve;

(c) releasably connecting said probe and said tester valve;

(d) communicating a fluid property measuring means of said probe with a formation fluid flow passage of said tester valve;

(e) reciprocating said probe to open and close said tester valve and provide flowing and shut-in conditions for measurement by said fluid property measuring means;

(f) retarding reciprocal movement of said probe in at least one direction; and (g) rapidly reversing of a direction of said probe during said step (f) and thereby disconnecting said probe from said tester valve.

18. The method of claim 17, wherein:

said step (f) is performed during every complete reciprocation of said probe while said probe is connected to said tester valve; and step (g) can be performed during any reciprocation of said probe while said probe is connected to said tester valve regardless of how many reciprocations of said probe have occurred.

19. The method of claim 17, wherein:

step (f) is further characterized as retarding only a latter portion of a stroke of said probe in said one direction.

20. The method of claim 17, wherein:

step (f) is further characterized as hydraulically retarding said reciprocal movement.

* * * * *

UNITED STATES PATENT AND TRADEMARK OFFICE

CERTIFICATE OF CORRECTION

PATENT NO. : 4,848,463

DATED : July 18, 1989

INVENTOR(S) : Paul D. Ringgenberg et al

It is certified that error appears in the above-identified patent and that said Letters Patent is hereby corrected as shown below:

In Column 4, Line 46, the word "dispsed" should read --disposed--

In Column 6, Line 47, delete the word "similar" and insert therefore the word --smaller--

In Column 7, Line 14, delete the word "loawer" and insert therefore the word --lower--, In Column 7, Line 32, delete the word "valvwe" and insert therefore the word --valve--

In Column 8, Line 33, delete the words [the sealing case 186,].

In Column 10, Line 59, the word "paths", should read --path--

In Column 11, Line 25, the delete the number "282" and insert therefore the number --382--

UNITED STATES PATENT AND TRADEMARK OFFICE

CERTIFICATE OF CORRECTION

PATENT NO. : 4,848,463

DATED : July 18, 1989

INVENTOR(S) : Paul D. Ringgenberg et al

It is certified that error appears in the above-identified patent and that said Letters Patent is hereby corrected as shown below:

In Column 13, Line 42, delete the word "sell" and insert therefore the word --well--, Signed and Sealed this Eighteenth Day of May, 1993

Attest:

Michael K. Kirk

MICHAEL K. KIRK

Attesting Officer

Acting Commissioner of Patents and Trademarks